US008764483B2

(12) United States Patent
Ellison

(10) Patent No.: US 8,764,483 B2
(45) Date of Patent: Jul. 1, 2014

(54) ELECTRICAL CONNECTOR

(75) Inventor: Jason John Ellison, Camp Hill, PA (US)

(73) Assignee: FCI Americas Technology LLC, Carson City, NV (US)

( * ) Notice: Subject to any disclaimer, the term of this patent is extended or adjusted under 35 U.S.C. 154(b) by 41 days.

(21) Appl. No.: 13/466,810

(22) Filed: May 8, 2012

(65) Prior Publication Data

US 2012/0302096 A1 Nov. 29, 2012

Related U.S. Application Data

(60) Provisional application No. 61/490,390, filed on May 26, 2011.

(51) Int. Cl.
*H01R 13/648* (2006.01)

(52) U.S. Cl.
USPC ..... 439/607.07

(58) Field of Classification Search
USPC ..... 439/607.05–607.16, 607.39
See application file for complete search history.

(56) References Cited

U.S. PATENT DOCUMENTS 5,499,935 A 3/1996 Powell
6,409,543 B1 * 6/2002 Astbury et al. ..... 439/607.07
6,746,278 B2 * 6/2004 Nelson et al. ..... 439/607.07

OTHER PUBLICATIONS

SFF Committee, "Mini Multilane Series Shielded Integrated Connector", ftp://ftp.seagate.com/sff, Feb. 26, 2010, 35 pages.

* cited by examiner

*Primary Examiner* — Ross Gushi
(74) *Attorney, Agent, or Firm* — Baker & Hostetler LLP

(57) ABSTRACT

An electrical connector includes a connector housing, a plurality of electrical contacts carried by the housing, including respective pluralities of signal contacts and ground contacts configured as crosstalk shields. Electrical characteristics exhibited by the electrical connector during operation can be tuned by modifying physical characteristics of one or more of the crosstalk shields, for instance by modifying the respective shield body of one or more of the plurality of crosstalk shields so as to alter a corresponding shield area defined by the shield body of each of the plurality of crosstalk shields.

23 Claims, 15 Drawing Sheets

ELECTRICAL CONNECTOR

CROSS-REFERENCE TO RELATED APPLICATIONS

This application claims the benefit of U.S. provisional patent application No. 61/490,390, filed May 26, 2011, the disclosure of which is incorporated herein by reference in its entirety.

BACKGROUND

Electrical connectors typically include housings that carry electrical contacts. The electrical contacts define mating ends that define a mating interface and opposed mounting ends that define a mounting interface, respectively, of the electrical connector. When signals are transmitted through the electrical contacts, electromagnetic fields generated in an individual electrical contact can induce interference into the signals carried by neighboring electrical contacts, for example by inducing crosstalk, thereby affecting the overall performance of the electrical connector.

For instance, referring to FIG. 1, an electrical assembly 10 can be configured as a typical industry standard CXP electrical assembly in accordance with SFF-8642 Specification, Rev. 2.7, Feb. 26, 2010, the disclosure of which is incorporated herein by reference in its entirety. The illustrated electrical assembly 10 can include a substrate such as a printed circuit board 12, an electrical connector assembly 14 configured to be mounted to the printed circuit board 12, and a complementary electrical component such as a complementary electrical connector 16 that can be shielded, and can be a cable connector. The complementary electrical connector 16 is configured to be mated to the shielded electrical connector assembly 14, such that the shielded electrical connector assembly 14 places the complementary electrical connector 16 in electrical communication with the printed circuit board 12. Each of the printed circuit board 12, the shielded electrical connector assembly 14, and the complementary electrical connector 16 can be configured in accordance with the SFF-8642 Specification, Rev. 2.7, Feb. 26, 2010.

However in operation the electrical connector assembly 14 of the illustrated industry standard CXP electrical assembly can exhibit undesirable electrical characteristics, for instance high insertion losses at certain select resonance frequencies (e.g., Q resonances). The insertion losses can adversely affect the electrical performance of the electrical connector assembly 14, and thus of the electrical assembly 10, for instance rendering the electrical connector assembly 14 to be marginally operable at data transfer rates of approximately ten gigabits per second (10 Gb/s) and substantially non-functional at data transfer rates of approximately fourteen gigabits per second (14 Gb/s).

SUMMARY

In accordance with an embodiment, an electrical connector includes a connector housing. The electrical connector further includes a plurality of signal contacts supported by the connector housing. Each of the plurality of signal contacts defines a mating end, an opposed mounting end, and an intermediate portion that extends from the mating end to the mounting end. The electrical connector further includes a plurality of crosstalk shields supported by the connector housing. Each of the plurality of crosstalk shields has a shield body that defines a front boundary, a lower boundary, and at least one outer boundary. Each crosstalk shield includes a plurality of ground mating ends that extend from the front boundary and a plurality of ground mounting ends that extend from the lower boundary. Each crosstalk shield further includes a housing that substantially encloses the shield body.

In accordance with another embodiment, a method includes the step of providing an electrical connector that includes a connector housing, a plurality of signal contacts supported by the connector housing, and a plurality of crosstalk shields supported by the connector housing. Each of the plurality of crosstalk shields defines a respective first shield area. The method further includes the step of measuring respective crosstalk resonance frequencies exhibited by the plurality of signal contacts during operation of the electrical connector. If any of the respective crosstalk resonance frequencies does not fall within a range of about −30 dB to about −60 dB, the method can further include the step of constructing a replacement shield for at least a select one of the plurality of crosstalk shields such that the replacement shield defines a replacement shield area that is different than the first shield area of the select one of the plurality of crosstalk shields, and the step of repeating the measuring and constructing steps until all of the respective crosstalk resonance frequencies exhibited during operation of the electrical connector are substantially within the range of about −30 dB to about −60 dB.

In accordance with still another embodiment, a kit includes a first electrical connector that includes a first connector housing. The first electrical connector further includes a first plurality of signal contacts supported by the first connector housing. Each of the first plurality of signal contacts defines a mating end, an opposed mounting end, and an intermediate portion that extends from the mating end to the mounting end. The first electrical connector further includes a first plurality of crosstalk shields supported by the first connector housing. Each of the first plurality of crosstalk shields has a shield body that defines a front boundary, a lower boundary, and an outer boundary. Each of the first plurality of crosstalk shields includes a plurality of ground mating ends that extend from the front boundary and a plurality of ground mounting ends that extend from the lower boundary. The kit further includes a second electrical connector that includes a second connector housing identical to the first connector housing. The second electrical connector further includes a second plurality of signal contacts identical to the first plurality of signal contacts. The second electrical connector further includes a second plurality of crosstalk shields supported by the second connector housing. Each of the plurality of crosstalk shields has a shield body that defines a front boundary, a lower boundary, and an outer boundary that is shaped differently than the outer boundary of the first plurality of crosstalk shields, such that each of the second plurality of crosstalk shields defines respective areas different than those of the first plurality of crosstalk shields.

In accordance with still another embodiment, a method of minimizing resonances in an electrical connector includes the step of teaching or providing an electrical connector that includes a connector housing, a plurality of signal contacts supported by the connector housing, and a plurality of crosstalk shields supported by the connector housing. Each of the plurality of crosstalk shields defines a respective first shield area. The method further includes the step of teaching the step of measuring respective crosstalk resonance frequencies exhibited by the plurality of signal contacts during operation of the electrical connector. The method further includes the step of teaching the step of constructing a replacement shield for at least a select one of the plurality of crosstalk shields if any of the respective crosstalk resonance frequencies does not fall within a range of about −30 dB to about −60 dB, such that the replacement shield defines a replacement shield area that is different than the first shield area of the select one of the plurality of crosstalk shields. The method further includes the step of teaching the step of repeating the measuring and constructing steps until all of the respective crosstalk resonance frequencies exhibited during operation of the electrical connector are substantially within the range of about −30 dB to about −60 dB.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1:
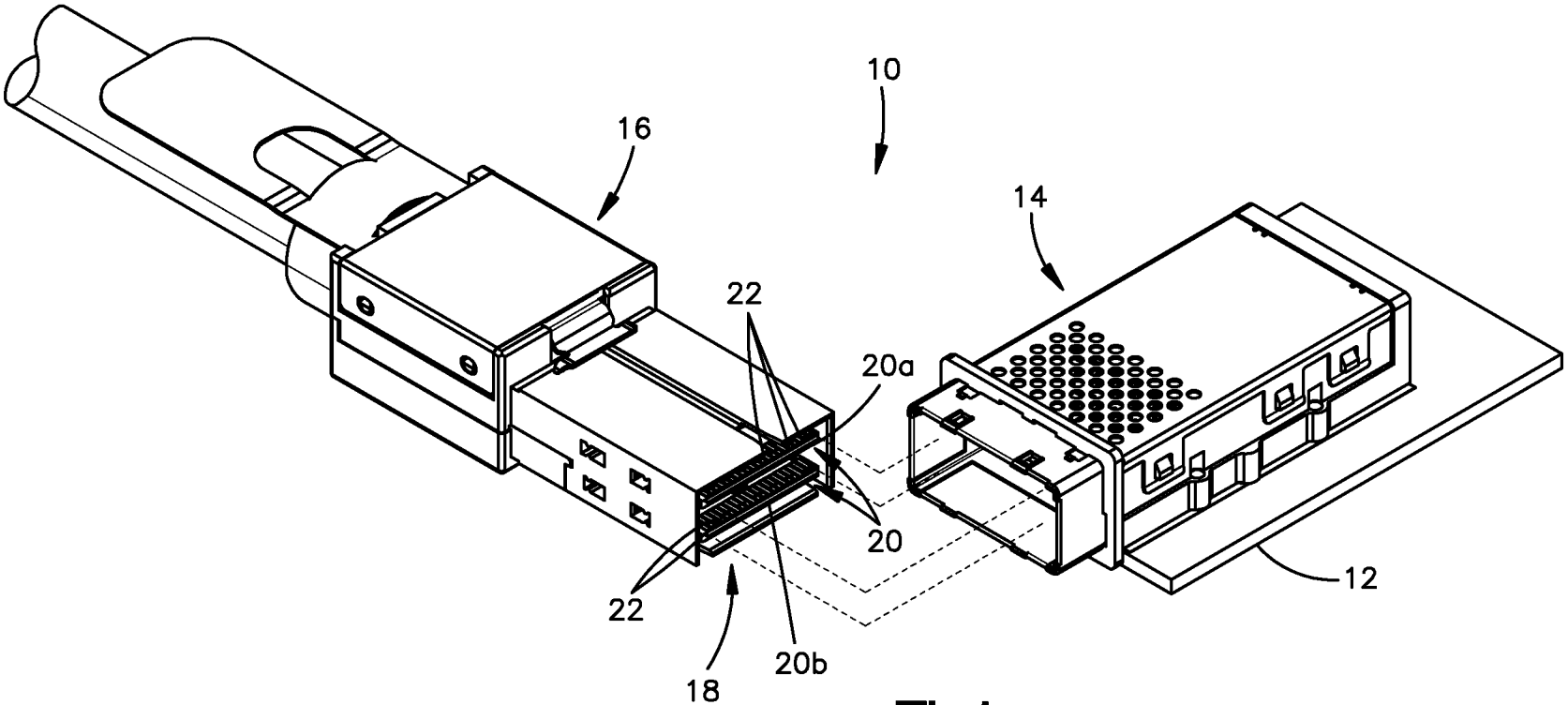
Fig.1 PRIOR ART
FIG. 1 is a perspective view of an industry standard CXP electrical assembly including a substrate, an electrical connector mounted to the substrate, and a complementary electrical component configured to be mated to the electrical connector.
Figure 2:
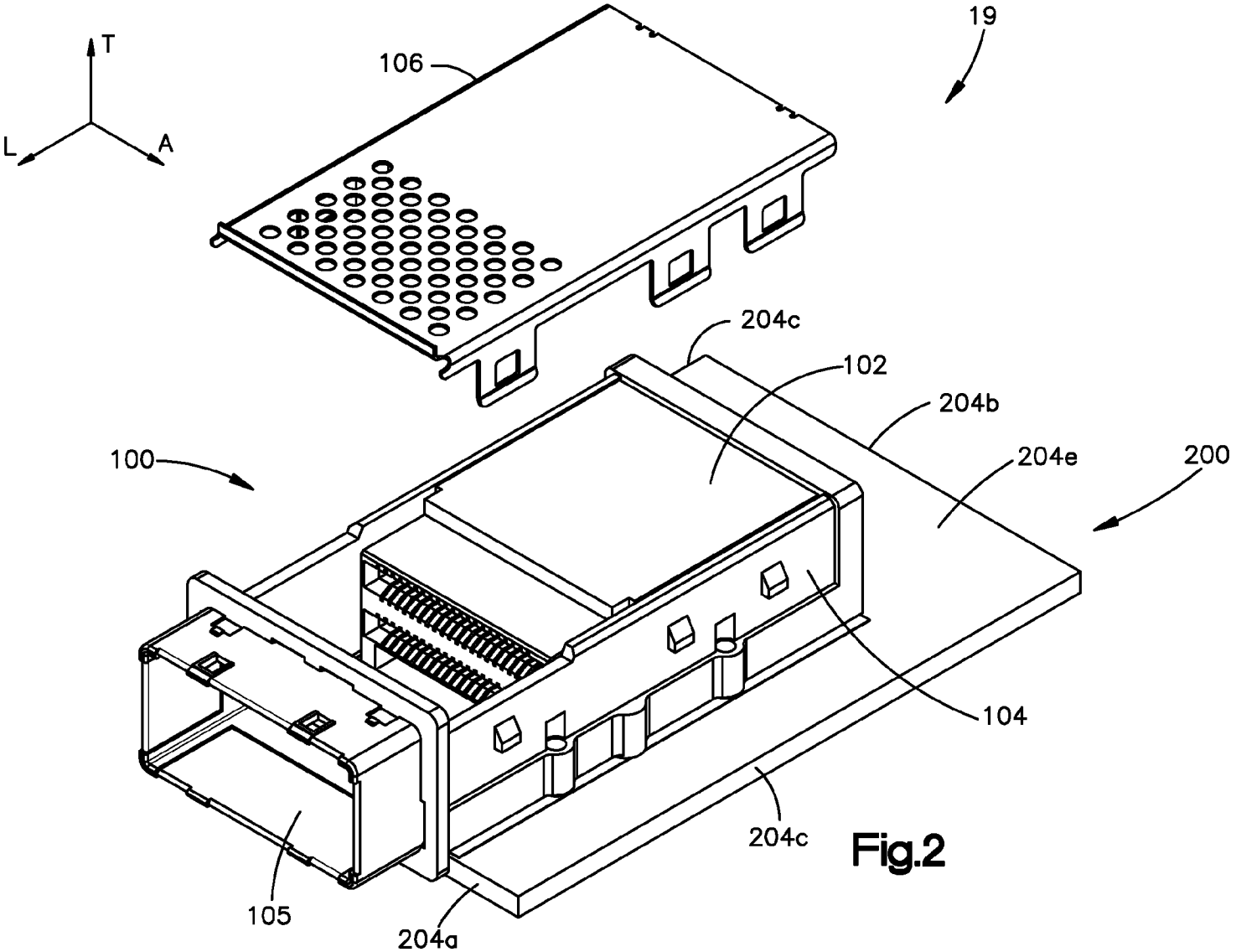
FIG. 2 is a perspective view of an electrical assembly constructed in accordance with an embodiment, the electrical assembly including a substrate and an electrical connector assembly mounted to the substrate.
Figure 3:
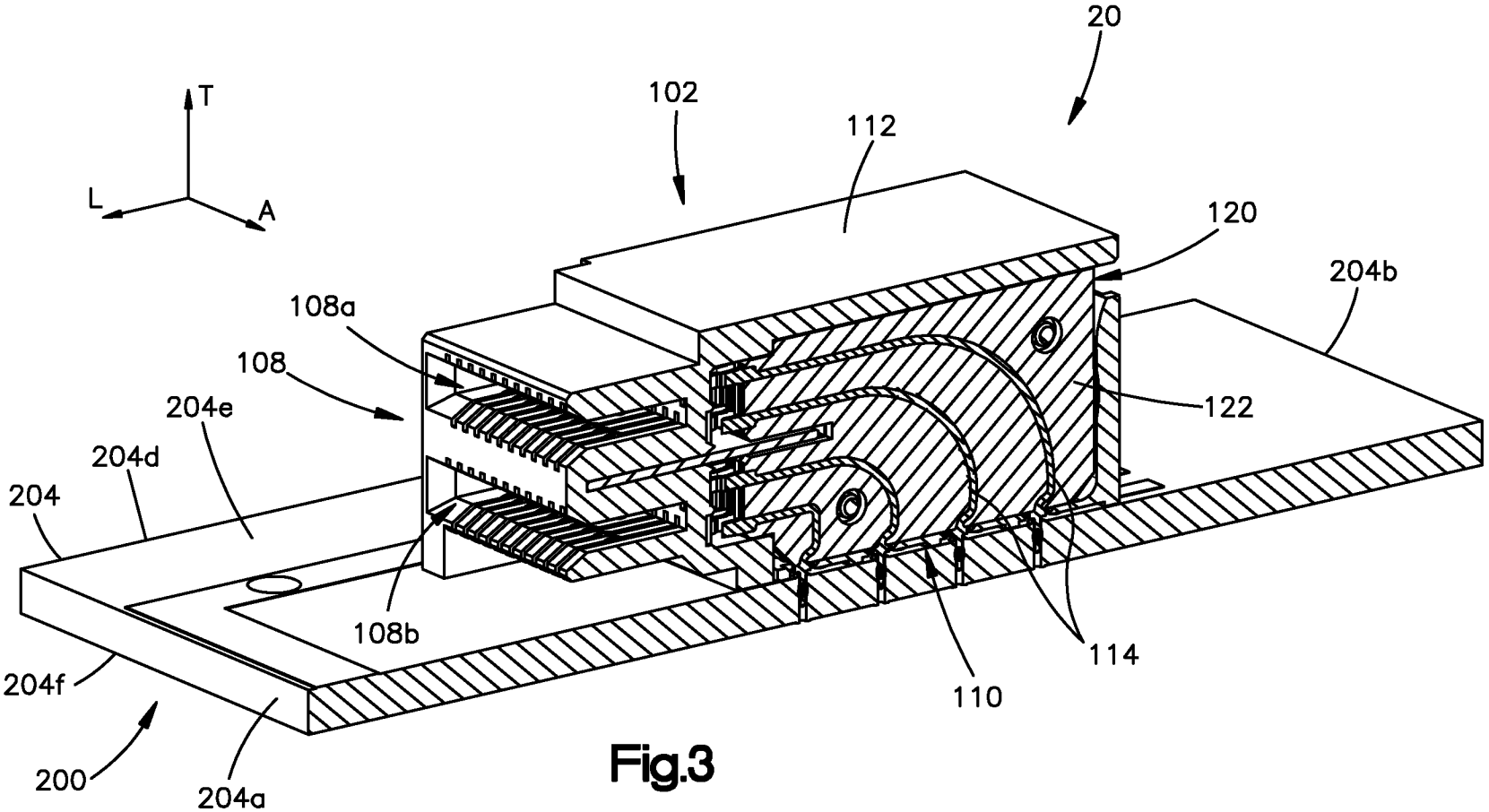
FIG. 3 is a perspective section view of the an electrical connector of the electrical connector assembly illustrated in FIG. 2, mounted to the substrate.

Referring initially to FIGS. 2-3, an electrical assembly 19 can include a substrate 200, such as a printed circuit board (PCB), and an electrical connector assembly 100 that is configured to be mounted to the substrate 200 so as to place the electrical connector assembly 100 in electrical communication with the substrate 200. The electrical assembly 19 can be configured to operate as a CXP electrical assembly. For instance, the electrical connector assembly 100 can be configured to be mated to a complementary electrical component configured as a CXP electrical component, for instance the complementary electrical connector 16 (see FIG. 1), such that the complementary electrical connector 16 (see FIG. 1) can be mated to the electrical connector assembly 100, such that the electrical connector assembly 100 places the complementary electrical connector 16 in electrical communication with the substrate 200. It should be appreciated, however, that the electrical assembly 19 can be alternatively constructed in any suitable manner as desired. For instance, the electrical connector assembly 100 can be constructed in any suitable manner as desired, unless otherwise indicated.

In accordance with the illustrated embodiment, the electrical connector assembly 100 includes an electrical connector 102 that is configured to be mounted to the substrate 200 so as to place the electrical connector 102 in electrical communication with the substrate 200. The electrical connector 102 can be configured to mate with a complementary electrical component, such as the complementary electrical connector 16, so as to place the electrical connector 102 in electrical communication with the complementary electrical connector 16, and thus the substrate 200.

In accordance with the illustrated embodiment, the electrical connector 102 can be constructed as a right-angle connector that defines a mating interface 108 and a mounting interface 110 that is oriented substantially perpendicular to the mating interface 108. The mounting interface 110 can be configured to be mounted onto an underlying substrate 200, such as the substrate 200. The mating interface 108 can be configured to mate with a complementary mating interface of a complementary electrical component that is configured to be mated to the electrical connector 102, such as the complementary electrical connector 16. For example, the complementary electrical connector 16 defines a mating interface 18 comprising a pair of paddle cards 20 including a first paddle card 20*a* and a second paddle card 20*b*. Each of the first and second paddle cards 20*a* and 20*b* can be configured as printed circuit boards that define a respective plurality of electrical contact pads 22 that are electrically connected to respective electrical traces of the first and second paddle cards 20*a* and 20*b*. Further in accordance with the illustrated embodiment, the mating interface 108 can include first and second receptacle pockets 108*a* and 108*b*, wherein the first receptacle pocket 108*a* can be positioned as an upper receptacle pocket configured to at least partially retain the first paddle card 20*a*, and the second receptacle pocket 108*b* can be positioned as a lower receptacle pocket configured to at least partially retain the second paddle card 20*b*.

The electrical connector assembly 100 can further include a guide frame housing 104 that is configured to be mounted to the substrate 200 such that the guide frame housing 104 at least partially encloses the electrical connector 102. The guide frame housing 104 can be configured to at least partially receive and to guide a complementary electrical component, such as the complementary electrical connector 16, during mating of the complementary electrical connector 16 to the electrical connector 102. For example, the guide frame housing 104 can include a receptacle pocket 105 that is configured to receive the mating interface 18 of the complementary electrical connector 16 and to at least partially align the first and second paddle cards 20*a* and 20*b* with the first and second receptacle pockets 108*a* and 108*b*, respectively when mating the complementary electrical connector 16 to the electrical connector 102. Additionally, the guide frame housing 104 can be configured to at least partially surround at least one or both of the electrical connector 102 or the complementary electrical component. The guide frame housing 104 can be constructed of any suitable dielectric or insulative material, such as plastic. The electrical connector assembly 100 can further include a shroud 106 that is configured to be attached to the guide frame housing 104, the shroud 106 configured to shield at least one or both of the electrical connector 102 or the complementary electrical connector 16, for example from electrical interference generated by other electrical components in a vicinity of the electrical assembly 19. Thus, the electrical connector assembly 100 can be configured as a shielded electrical connector assembly. The shroud 106 can be constructed of any suitable material, such as metal.

The electrical connector 102 can include a dielectric or electrically insulative connector housing 112 and a plurality of electrical contacts 114 supported by the connector housing 112. The plurality of electrical contacts 114 can include respective pluralities of signal contacts 116 and ground contacts 118. The electrical connector 102 can include a plurality of leadframe assemblies 120 supported by the connector housing 112. For example, in accordance with the illustrated embodiment, the electrical connector 102 can include a plurality of leadframe assemblies 120 that can be substantially identically constructed, or can include respective pluralities of three different leadframe assemblies 120, including a plurality of first leadframe assemblies 120*a* that configured as signal leadframe assemblies, a plurality of second leadframe assemblies and 120*b* configured as signal leadframe assemblies, and a plurality of third leadframe assemblies 120*c* configured as ground leadframe assemblies. Each of the plurality of leadframe assemblies 120 can include a respective dielectric or electrically insulative leadframe housing 122 that carries respective ones of the plurality of electrical contacts 114. For instance, each of the leadframe assemblies 120 can be configured as an insert molded leadframe assembly (IMLA) whereby the leadframe housing 122 is overmolded onto the respective ones of the plurality of electrical contacts 114. Alternatively, the respective ones of the plurality of electrical contacts 114 can be stitched into the leadframe housing 122 or otherwise supported by the leadframe housing 122. The electrical connector 102, for instance the leadframe assemblies 120, can include a dielectric material, such as air or plastic, that electrically isolates individual ones of the plurality of electrical contacts 114 from one another.

Referring now to FIGS. 5A-5B, 6A-6B, and 7A-7B the leadframe housing 122 of each leadframe assembly 120 includes a housing body 124 that defines a front end 124*a* that is disposed proximate to the mating interface 108 of the electrical connector 102 when the leadframe assembly 120 is supported by the connector housing 112, a rear end 124*b* that is spaced from the front end 124*a* along a first direction that can define a longitudinal direction L, an upper end 124*c* and an opposed lower end 124*d* that is disposed proximate to the mounting interface 110 of the electrical connector 102 when the leadframe assembly 120 is supported by the connector housing 112 and that is spaced from the upper end 124*c* along a second direction that can define a transverse direction T that extends substantially perpendicular to the longitudinal direction L, and opposed first and second side surfaces 124*e* and 124*f* that are spaced apart from each other along a third direction that can define a lateral direction A that extends substantially perpendicular to both the longitudinal direction L and the lateral direction A. The leadframe housings 122 of the plurality of leadframe housings 122 can be constructed of any suitable dielectric or insulative material as desired, for instance plastic. It should be appreciated that in accordance with the illustrated embodiment, the longitudinal direction L and the lateral direction A are oriented horizontally, and the transverse direction T is oriented vertically, though it should be appreciated that the orientation of the electrical connector assembly 100 can vary during use. Unless otherwise specified herein, the terms "lateral," "laterally," "longitudinal," "longitudinally," "transverse," and "transversely" are used to designate perpendicular directional components in the drawings to which reference is made.

Each of the first leadframe assemblies 120*a* can be configured to attach to a corresponding one of the second leadframe assemblies 120*b* when the respective pluralities of first and second leadframe assemblies 120*a* and 120*b* are supported by the connector housing 112. For example, the respective leadframe housings 122 of each of the plurality of first leadframe assemblies 120*a* can define at least one interface member 138, such as a plurality of interface members 138 that are configured to engage with complementary interface members 138 defined by the respective leadframe housings 122 of each of the plurality of second leadframe assemblies 120*b*. It should be appreciated, however, that the first, second, and third leadframe assemblies 120*a*, 120*b*, and 120*c*, respectively, can be supported by the connector housing 112 in any manner as desired.

In accordance with the illustrated embodiment, the interface members 138 can be configured as at least one post 140, such as a pair of posts 140, that extends out from the housing body 204, for instance out from the second side surface 204*f* of the housing body 204. The posts 140 can extend from the housing body 204 of the first leadframe assembly 120*a* along any direction as desired, such as the lateral direction A as illustrated. The interface members 138 can be constructed as at least one aperture 142, such as a pair of apertures 142, defined by the housing body 204 of the second leadframe assembly 120*b*. For instance, the apertures 142 can extend into the first side surface 204*e* of the housing body 204 along any direction as desired, such as the lateral direction A as illustrated. The apertures 142 can be sized to receive the posts 140 so as to attach the first and second leadframe assemblies 120*a* and 120*b* to each other such that the first and second leadframe assemblies 120*a* and 120*b* are disposed adjacent to each other along the lateral direction A. While interface members 138 of the first leadframe assemblies 120*a* are configured as posts 140, and the interface members 138 of the second leadframe assemblies 120*b* can be configured as apertures 142 in accordance with the illustrated embodiment, it should be appreciated that the interface members 138 of the first leadframe assemblies 120*a* can be configured as apertures 142, and the interface members 138 of the second leadframe assemblies 120*b* can be configured as posts 140. Thus, the first and second leadframe assemblies 120*a* and 120*b* can define respective interface members that attach the first and second leadframe assemblies 120*a* and 120*b* to each other such that the first and second leadframe assemblies 120*a* and 120*b* are disposed adjacent to each other along the lateral direction A.

In accordance with the illustrated embodiment, the posts 140 can be integral and monolithic with the respective leadframe housings 122 of the plurality of first leadframe assemblies 120*a*. Alternatively, the posts 140 can be separate and can be attached to the respective leadframe housings 122 of the plurality of first leadframe assemblies 120*a*. Each of the apertures 142 is sized to receive a corresponding one of the posts 140. It should be appreciated that the first and second leadframe assemblies 120*a* and 120*b* are not limited to the illustrated interface members 138, and that the respective leadframe housings 122 of the first and second leadframe assemblies 120*a* and 120*b* can be alternatively constructed with any other suitable arrangement of interface members 138 as desired.

Figure 4:
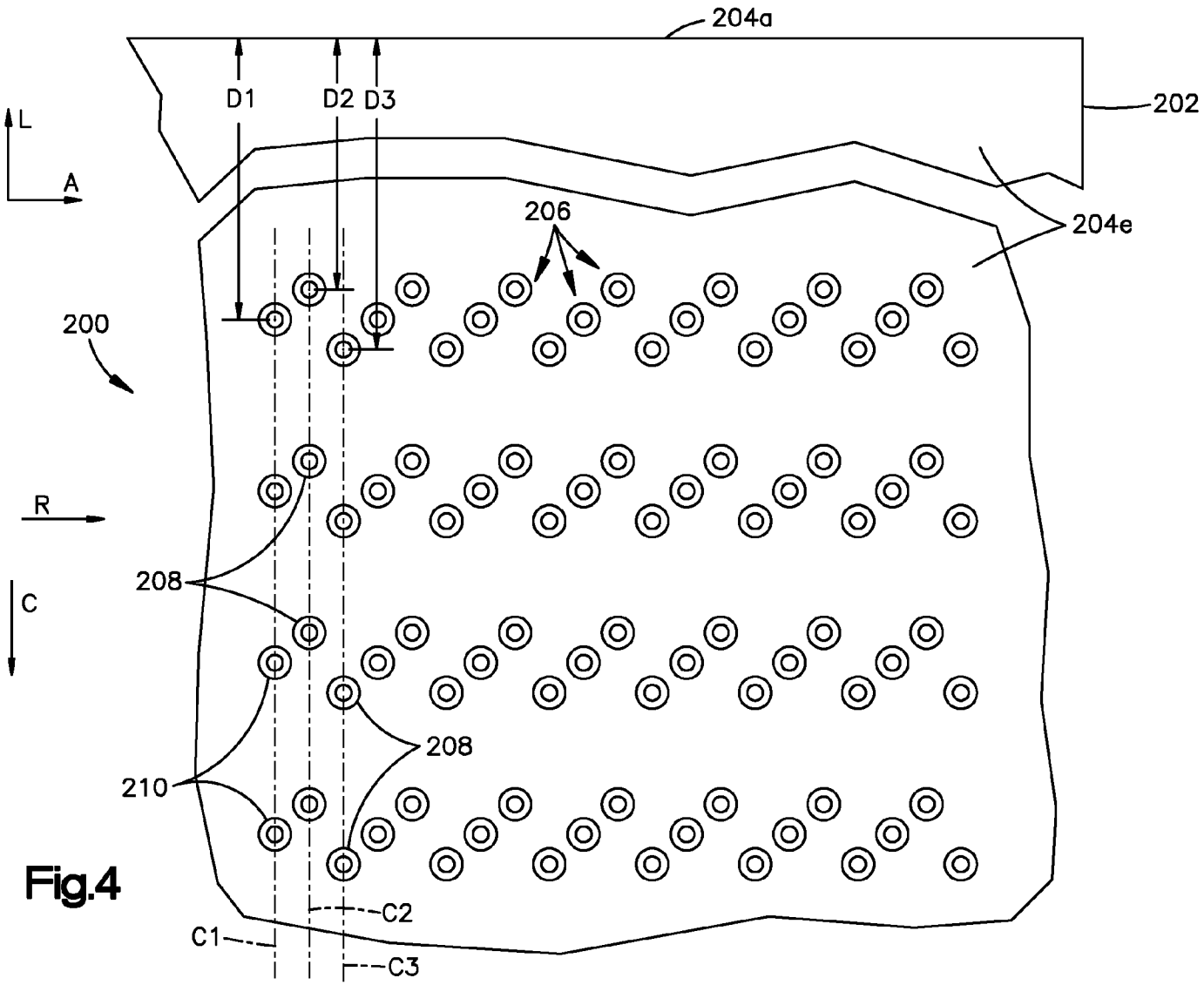
FIG. 4 is a top elevation view of the substrate illustrated in FIG. 1.

Referring now to FIG. 4, the substrate 200 can include a substrate body 204 that defines a front end 204*a*, a rear end 204*b* that is spaced from the front end 204*a* along the longitudinal direction L, opposed first and second sides 204*c* and 204*d* that are spaced apart from each other along the lateral direction A, an upper surface 204*e*, and a lower surface 204*f* that is spaced from the upper surface 204*e* along the transverse direction T. The substrate 200 can further include at least one such as a plurality of electrically conductive elements that can be supported by the substrate 200, for instance by the substrate body 204. The electrically conductive elements can be electrically connected to electrically conductive traces that are routed through the substrate body 204 or along one or more surfaces of the substrate body 204, such as along the upper surfaces 204*e*.

In accordance with illustrated embodiment, the substrate 200 includes a plurality of electrically conductive elements in the form of a plurality of vias 206 that can be configured as plated through holes that extend into, such as through, the substrate body 204 along the transverse direction T, for instance into the upper surface 204*e*. Each of the plurality of vias 206 can be configured to receive a complementary portion of a respective one of the plurality of electrical contacts 114, thereby placing the respective one of the plurality of electrical contacts 114 in electrical communication with the substrate 200. The plurality of vias 206 can include at least one or both of electrical (for instance electrically conductive) signal vias 208 or electrical (for instance electrically conductive) ground vias 210, in any combination as desired.

The plurality of vias 206 can be disposed along the upper surface 204*e* of the substrate body 204 in accordance with any suitable arrangement, such that the plurality of vias 206 define a via footprint configured to receive a corresponding arrangement of the plurality of electrical contacts 114 of the electrical connector 102. The vias 206 of the footprint can be arranged into columns of vias 206 along a column direction C that extends substantially parallel to the longitudinal direction L and into rows of vias 206 along a row direction R that extends substantially parallel to the lateral direction A. It should be appreciated that the columns of vias 206 are spaced from each other along the row direction R, and that the rows of vias 206 are spaced apart from each other along the column direction C. The footprint can include respective pluralities of electrical signal vias 208 and electrical ground vias 210.

In accordance with the illustrated embodiment, the vias 206 can be arranged so as to define a footprint that includes respective columns of electrical signal vias 208 and electrical ground vias 210 that are arranged in a three-column pattern that is repeated from left to right across the upper surface 204*e* of the substrate body 204, between the first and second sides 204*c* and 204*d*, respectively. In accordance with the illustrated footprint, the repeating pattern includes a first column C1 of vias 206 that includes four electrical ground vias 210 that are spaced substantially equally from each other and centrally aligned with respect to each other along the column direction C, a second column C2 of vias 206 that includes four electrical signal vias 208 that are spaced substantially equally from each other and centrally aligned with respect to each other along the column direction C, and a third column C3 of vias 206 that includes four electrical signal vias 208 that are spaced substantially equally from each other and centrally aligned with respect to each other along the column direction C. The first, second, and third columns C1, C2, and C3 of vias 206 are spaced apart from each other substantially equally along the row direction R. Moreover, the spacing between the respective vias 206 in each column is substantially equal for each of the first, second, and third columns C1, C2, and C3, respectively.

Further in accordance with the illustrated footprint, the center of the electrical ground via 210 of first column C1 of vias 206 that is closest to the front end 204*a* of the substrate body 204 is spaced from the front end 204*a* a first distance D1. The center of the electrical signal via 208 of the second column C2 of vias 206 that is closest to the front end 204*a* is spaced from the front end 204*a* a second distance D2 that is shorter than the first distance D1, such that the electrical signal vias 208 of the second column C2 of vias 206 are spaced longitudinally forward of corresponding electrical ground vias 210 of the first column C1 of vias 206. The center of the electrical signal via 208 of the third column C3 of vias 206 that is closest to the front end 204*a* is spaced from the front end 204*a* a third distance D3 that is longer than both the first distance D1 and the second distance D2, such that the electrical ground vias 210 of the first column C1 of vias 206 and the electrical signal vias 208 of the second column C2 of vias 206 are spaced longitudinally forward of corresponding electrical signal vias 208 of the third column C3 of vias 206.

In accordance with the illustrated embodiment, the three-column pattern comprising the first, second, and third columns C1, C2, and C3 of vias 206 can be repeated from left to right across the upper surface 204*e* of the substrate body 204, between the first and second sides 204*c* and 204*d*, respectively, such that the footprint includes fourteen columns of electrical signal vias 208, each including four electrical signal vias 208, and seven columns of electrical ground vias 210, each including four electrical ground vias 210. In this regard, the illustrated footprint includes twenty one columns of vias 206, arranged in a repeating pattern of a column of electrical ground vias 210 followed by two columns of electrical signal vias 208, from left to right across the upper surface 204*e* of the substrate body 204, between the first and second sides 204*c* and 204*d*, respectively. In accordance with the illustrated embodiment, each of the twenty one columns of vias 206 are spaced apart from each other substantially equally along the row direction R. Further in accordance with the illustrated embodiment, the footprint includes eight rows of electrical signal vias 208 and four rows of electrical ground vias 210, with each row of electrical ground vias 210 disposed between a first flanking row of electrical signal vias 208 and a second flanking row of electrical signal vias 208. In this regard, the illustrated footprint includes twelve rows of vias 206, arranged in a repeating pattern of two rows of electrical signal vias 208 with a row of electrical ground vias 210 disposed between the two rows of electrical signal vias 208, from front to back, across the upper surface 204*e* of the substrate body 204, between the front and rear ends 204*a* and 204*b* of the substrate body 204, respectively.

Referring now to FIGS. 5A-5C and 6A-6C, each of the plurality of signal contacts 116 includes a contact body that defines a mating end 128, an opposed mounting end 130 that is spaced from the mating end 128, and an intermediate portion 132 that extends from the mating end 128 to the mounting end 130. In accordance with the illustrated embodiment, the intermediate portion 132 of each of the plurality of signal contacts 116 defines at least one region of curvature, such that each intermediate portion 132 can be said to be curved between the mating end 128 and the mounting end 130. The mating end 128 of each of the plurality of signal contacts 116 defines a pair of opposed broadsides 134 that are spaced apart from each other along the lateral direction A and a pair of opposed edges 136 that are spaced apart from each other along the transverse direction T. The broadsides 134 of each of the plurality of signal contacts 116 extend from a first one of the opposed edges 136 to the other one of the opposed edges 136. Similarly, the edges 136 of each of the plurality of signal contacts 116 extend from a first one of the opposed broadsides 134 to the other one of the opposed broadsides 134. The mating end 128 of each of the plurality of signal contacts 116 can be disposed proximate to, for instance substantially at, the mating interface 108, and can define a respective portion of the mating interface 108. Similarly, the mounting end 130 of each of the plurality of signal contacts 116 can be disposed proximate to, for instance substantially at, the mounting interface 110, and can define a respective portion of the mounting interface 110.

The electrical connector 102 can be configured to be mated with, and unmated from, a complementary electrical component, for instance the complementary electrical connector 16, along a mating direction M that extends substantially parallel to the longitudinal direction L. In accordance with the illustrated embodiment, mating ends 128 of the plurality of signal contacts 116 extend forward from the front ends 124*a* of respective ones of the leadframe housings 122, substantially along the longitudinal direction L, and define receptacle mating ends 128 that are configured to receive mating ends of complementary electrical contacts of a complimentary electrical component so as to electrically connect to the complementary electrical contacts. For example, respective ones of the illustrated receptacle mating ends 128 can be configured to make contact with corresponding ones of the electrical contact pads 22 of the first and second paddle cards 20*a* and 20*b* of the complementary electrical connector 16 when the complementary electrical connector 16 is mated to the electrical connector 102, thereby placing the complementary electrical connector 16 in electrical communication with the electrical connector 102. In accordance with the illustrated embodiment, the electrical contact pads 22 are received between the upper and lower signal contacts 116*a* and 116*b* of first and second pairs 144 and 146 of signal contacts 116, as are described in more detail below. In this regard, the electrical connector 102, and in particular the mating interface 108, can be said to be mating compatible with complementary electrical components constructed in accordance with SFF-8642 Specification, Rev. 2.7, Feb. 26, 2010.

Further in accordance with the illustrated embodiment, the plurality of signal contacts 116 can define mounting ends 130 that are configured to electrically connect to respective electrical traces of the substrate 200 when the electrical connector 102 is mounted to the substrate 200. For instance, the illustrated mounting ends 130 define eye-of-the-needle press-fit tails that are configured to be inserted, or press-fit, into respective ones of the plurality of electrical signal vias 208 of the substrate 200. It should be appreciated that the mounting ends 130 are not limited to the illustrated press-fit tails, and that the mounting ends 130 can alternatively be configured as press-fit tails, surface mount tails, or fusible elements such as solder balls. In accordance with the illustrated embodiment, the mating ends 128 of each of the plurality of signal contacts 116 of the first and second leadframe assemblies 120*a* and 120*b* can protrude forward along the longitudinal direction L from the front end 124*a* of the housing body 124, and the mounting ends 130 can protrude downward along the transverse direction T from the lower end 124*d* of the housing body 124.

The respective signal contacts 116 of each of the first and second leadframe assemblies 120*a* and 120*b* can define a first or upper pair 144 of signal contacts 116, such that the respective mating ends 128 of the first pair 144 of signal contacts 116 are spaced apart from each other along the transverse direction T so as to define a respective portion of the first receptacle pocket 108*a* of the mating interface 108. Similarly, the respective signal contacts 116 of each of the first and second leadframe assemblies 120*a* and 120*b* can define a second or lower pair 146 of signal contacts 116, such that the respective mating ends 128 of the second pair 146 of signal contacts 116 are spaced apart from each other along the transverse direction T so as to define a respective portion of the second receptacle pocket 108*b* of the mating interface 108.

Each of the first and second pairs 144 and 146 of signal contacts 116 can define a first or upper signal contact 116*a* and a second or lower signal contact 116*b* that is disposed closer to the mounting interface 110 than the first or upper signal contact 116*a*. In this regard, the first pairs 144 of signal contacts 116 of the respective pluralities of first and second leadframe assemblies 120*a* and 120*b* can define respective first and second rows of signal contacts 116 that are disposed along the first receptacle pocket 108*a*, and the second pairs 146 of signal contacts 116 of the respective pluralities of first and second leadframe assemblies 120*a* and 120*b* can define respective third and fourth rows of signal contacts 116 that are disposed along the second receptacle pocket 108*b*. In accordance with the illustrated embodiment, when the complementary electrical connector 16 is mated to the electrical connector 102, the first paddle card 20*a* is received between the respective mating ends 128 of the first pairs 144 of signal contacts 116 disposed along the first receptacle pocket 108*a*, and the second paddle card 20*b* is received between the respective mating ends 128 of the second pairs 146 of signal contacts 116 disposed along the second receptacle pocket 108*b*.

Referring again to FIGS. 5A-5C and 6A-6C, in accordance with the illustrated embodiment the respective mating ends 128 of the signal contacts 116 of each of the first and second leadframe assemblies 120*a* and 120*b* are spaced apart from each other along the transverse direction T, such that each of the first and second leadframe assemblies 120*a* and 120*b* defines a respective column of signal contacts 116. Furthermore, the respective mounting ends 130 of the signal contacts 116 of each of the first and second leadframe assemblies 120*a* and 120*b* are spaced apart from each other along the longitudinal direction L, such that the mounting interface 110 is oriented substantially perpendicular to the mating interface 108. In this regard, each of the plurality of signal contacts 116 is configured as right-angle signal contacts. It should be appreciated that the signal contacts 116 can be differently constructed, for instance as vertical signal contacts, such that the mounting interface 110 is oriented substantially parallel to the mating interface 108.

Figure 7A:
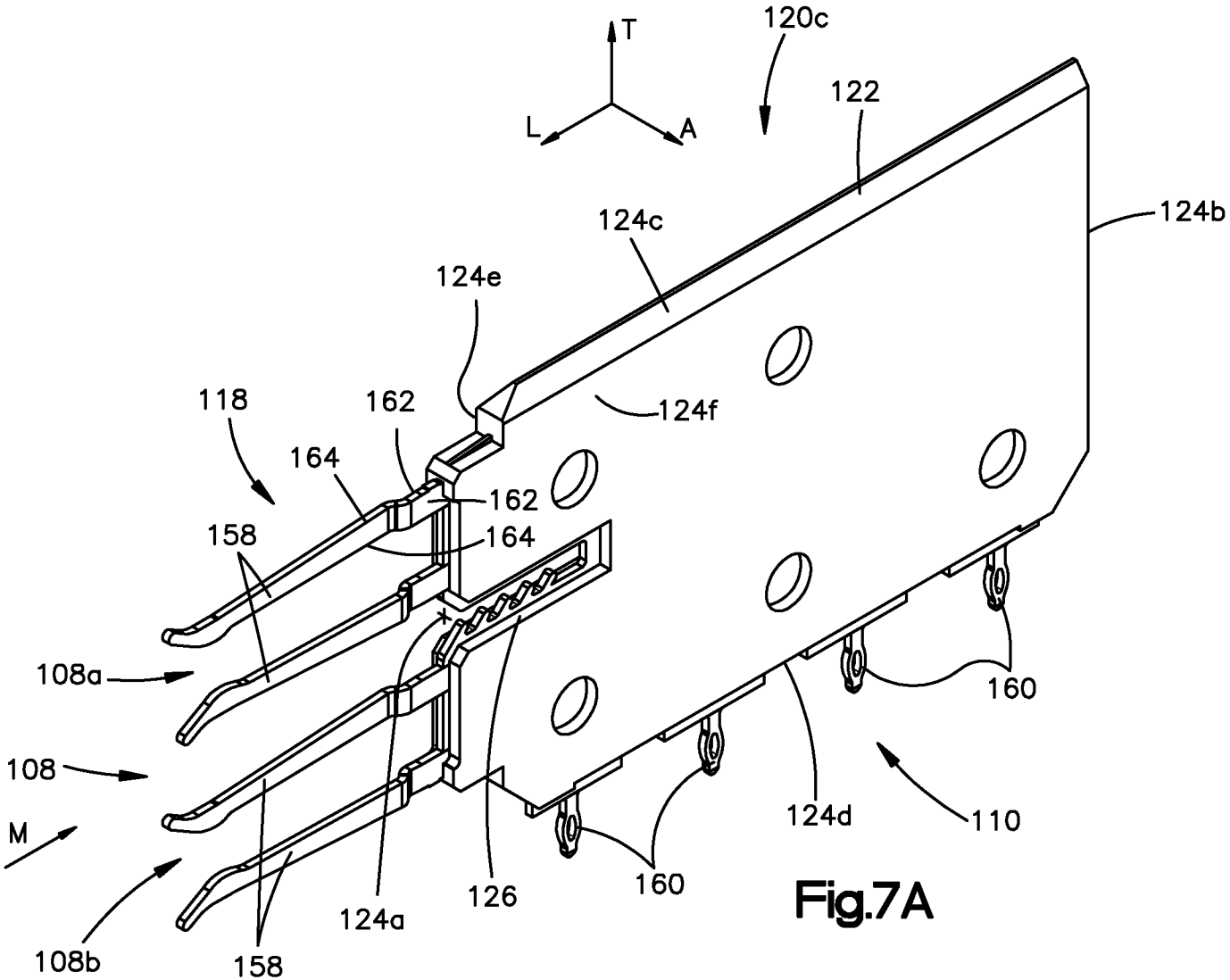
FIG. 7A is a perspective view of a leadframe assembly constructed in accordance with a third embodiment, the leadframe assembly including a leadframe housing and a crosstalk shield supported by the leadframe housing.
Figure 7B:
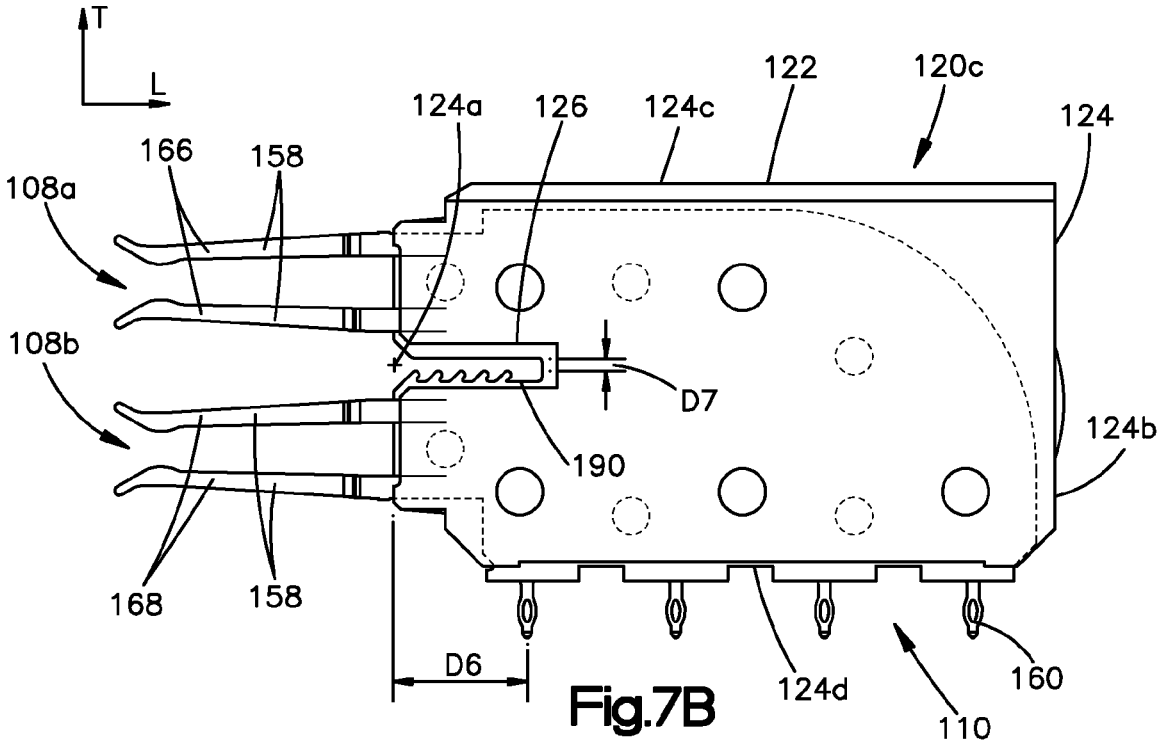
FIG. 7B is a side elevation view of the leadframe assembly illustrated in FIG. 7A.
Figure 7C:
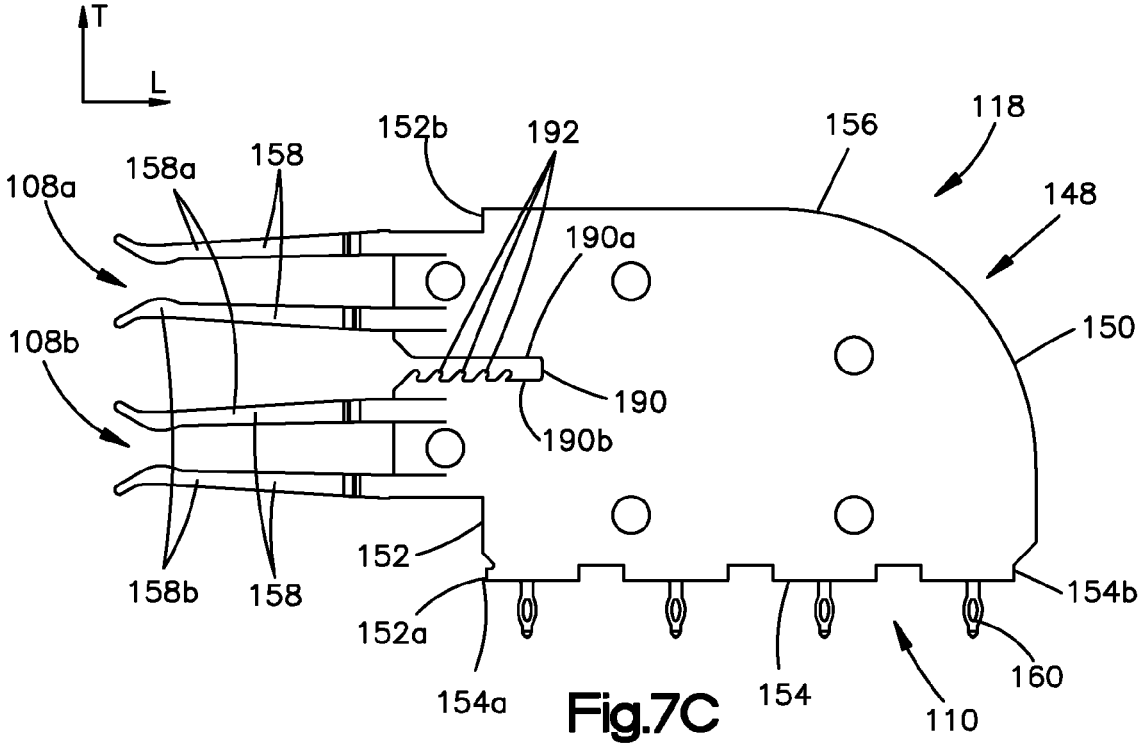
FIG. 7C is a side elevation view of the leadframe assembly illustrated in FIG. 7A with the leadframe housing removed, exposing the crosstalk shield.

Referring now to FIGS. 7A-7C, each third leadframe assembly 120*c* of the plurality of third leadframe assemblies 120*c* can include a ground contact 118 configured as an electrically conductive crosstalk shield 148. Each crosstalk shield 148 includes a shield body 150 that defines a front boundary 152, a lower boundary 154, and at least one outer boundary 156 that extends from the front boundary 152 to the lower boundary 154. The front boundary 152 can extend from a lower front boundary corner 152*a* to an upper front boundary corner 152*b* that is spaced from the lower front boundary corner 152*a* along the transverse direction T. Similarly, the lower boundary 154 can extend from a front lower boundary corner 154*a* that is substantially coincident with the lower front boundary corner 152*a* to a rear lower boundary corner 154*b* that is spaced from the front lower boundary corner 154*a* along the longitudinal direction L. In this regard, it can be said that the front boundary 152 is oriented substantially perpendicular to the lower boundary 154. In accordance with the illustrated embodiment, the outer boundary 156 extends from the upper front boundary corner 152*b* to the rear lower boundary corner 154*b* of the of the crosstalk shields 148.

Further in accordance with the illustrated embodiment, the connector housing 112 supports the plurality of third leadframe assemblies 120*c*, and the thus the plurality of crosstalk shields 148, such that the respective front boundaries 152 of the crosstalk shields 148 are disposed rearward of the mating interface 108, and such that the respective lower boundaries 154 are disposed substantially at the mounting interface 110. The leadframe housing 122 of each third leadframe assembly 120*c* can be overmolded onto the crosstalk shield 148, such that the leadframe housing 122 substantially encloses the shield body 150. Alternatively, the crosstalk shield 148 of each third leadframe assembly can be stitched into the leadframe housing 122 or otherwise supported by the leadframe housing 122. In accordance with the illustrated embodiment, the ground mating ends 158 of each crosstalk shield 148 can protrude forward along the longitudinal direction L from the front end 124*a* of the housing body 124, and the ground mounting ends 160 of each crosstalk shield 148 can protrude downward along the transverse direction T from the lower end 124*d* of the housing body 124.

Each crosstalk shield 148 includes a plurality of ground mating ends 158 that extend forward from the front boundary 152 along the longitudinal direction L and a plurality of ground mounting ends 160 that extend downward from the lower boundary 154 along the transverse direction T. Each of the ground mating ends 158 of each of the plurality of crosstalk shields 148 defines a pair of opposed broadsides 162 that are spaced apart from each other along the lateral direction A and a pair of opposed edges 164 that are spaced apart from each other along the transverse direction T. The broadsides 162 of each ground mating end 158 extend from a first one of the opposed edges 164 to the other one of the opposed edges 164. Similarly, the edges 164 of each ground mating end 158 extend from a first one of the opposed broadsides 162 to the other one of the opposed broadsides 162. The ground mating ends 158 of the plurality of crosstalk shields 148 can be disposed proximate to, for instance substantially at, the mating interface 108, and can define a respective portion of the mating interface 108. Similarly, the ground mounting ends 160 of each of the plurality of crosstalk shields can be disposed proximate to, for instance substantially at, the mounting interface 110, and can define a respective portion of the mounting interface 110.

The ground mating ends 158 of each crosstalk shield 148 are spaced apart from each other along the transverse direction T such that the ground mating ends 158 of each third leadframe assembly 120*c* define a respective column of ground mating ends 158. Similarly, the ground mounting ends 160 are spaced apart from each other along the longitudinal direction L. In accordance with the illustrated embodiment, each crosstalk shield 148 can be disposed adjacent to at least one column of signal contacts 116, such as a pair of columns of signal contacts 116, or can be disposed between a first pair of columns of signal contacts 116 and a second pair of columns of signal contacts 116, in the connector housing 112.

In accordance with the illustrated embodiment, the ground mating ends 158 of each of the plurality of crosstalk shields 148 can define receptacle mating ends 158 that are constructed substantially identically to the mating ends 128 of the plurality of signal contacts 116, such that the ground mating ends 158 are configured to receive mating ends of complementary electrical contacts of a complimentary electrical component so as to electrically connect to the complementary electrical contacts. For example, respective ones of the illustrated receptacle ground mating ends 158 can be configured to make contact with corresponding ones of the electrical contact pads 22 of the first and second paddle cards 20*a* and 20*b* of the complementary electrical connector 16 when the complementary electrical connector 16 is mated to the electrical connector 102, thereby placing the complementary electrical connector 16 in electrical communication with the electrical connector 102. In accordance with the illustrated embodiment, the electrical contact pads 22 are received between the upper and lower ground mating ends 158*a* and 158*b* of first and second pairs 166 and 168 of ground mating ends 158, as are described in more detail below.

It should be appreciated that because the electrical contact pads 22 of the complementary electrical connector 16 are received between the upper and lower signal contacts 116*a* and 116*b* of the first and second pairs 144 and 146 of signal contacts 116 and between the upper and lower ground mating ends 158*a* and 158*b* of the first and second pairs 166 and 168 of ground mating ends 158, the electrical connector 102, and in particular the mating interface 108, can be said to be mating compatible with complementary electrical components constructed in accordance with SFF-8642 Specification, Rev. 2.7, Feb. 26, 2010.

Because the mating ends 128 of the plurality of signal contacts 116 and the ground mating ends 158 of the plurality of crosstalk shields 148 are configured as receptacle mating ends and receptacle ground mating ends, respectively, the electrical connector 102 can be referred to as a receptacle electrical connector. Furthermore, because the mating interface 108 is oriented substantially perpendicular to the mounting interface 110, the electrical connector 102 can be referred to as a right-angle electrical connector. However it should be appreciated that the electrical connector 102 can alternatively be provided in any desired configuration so as to electrically connect an underlying substrate 200, such as the substrate 200, to a complementary electrical component, such as the complementary electrical connector 16. For instance, the electrical connector 102 can alternatively be constructed as a plug or header electrical connector with electrical contacts 114 having spade, or plug mating ends and ground mating ends configured to be plugged into, or received by complementary receptacle mating ends of the electrical contacts of a complementary electrical connector that is to be mated to the electrical connector 102. Additionally, the electrical connector 102 can be configured as a vertical connector, whereby the mating interface 108 is oriented substantially parallel to the mounting interface 110.

Further in accordance with the illustrated embodiment, the plurality of ground mounting ends 160 can be constructed substantially identically to the mounting ends 130 of the plurality of signal contacts 116, such that plurality of ground mounting ends 160 are configured to electrically connect to respective electrical traces of the substrate 200 when the electrical connector 102 is mounted to the substrate 200. The illustrated ground mounting ends 160 define eye-of-the-needle press-fit tails that are configured to be inserted, or press-fit, into respective ones of the plurality of electrical ground vias 210 of the substrate 200. It should be appreciated that the ground mounting ends 160 are not limited to the illustrated press-fit tails, and that the ground mounting ends 160 can alternatively be configured as press-fit tails, surface mount tails, or fusible elements such as solder balls.

The respective ground mating ends 158 of the crosstalk shield 148 of each of the plurality of third leadframe assemblies 120*c* can define a first or upper pair 166 of ground mating ends 158, such that the respective ground mating ends 158 of the upper pair 166 of ground mating ends 158 are spaced apart from each other along the transverse direction T so as to define a respective portion of the first receptacle pocket 108*a* of the mating interface 108. Similarly, the respective ground mating ends 158 of the crosstalk shield 148 of each of the plurality of third leadframe assemblies 120*c* can define a second or lower pair 168 of ground mating ends 158, such that the respective ground mating ends 158 of the lower pair 168 of ground mating ends 158 are spaced apart from each other along the transverse direction T so as to define a respective portion of the second receptacle pocket 108*b* of the mating interface 108.

Each of the first and second pairs 166 and 168 of ground mating ends 158 can define a first or upper ground mating end 158*a* and a second or lower ground mating end 158*b* that is disposed closer to the mounting interface 110 than the first or upper ground mating end 158*a*. In this regard, the first pairs 166 of ground mating ends 158 of the plurality of third leadframe assemblies 120*c* can define respective first and second rows of ground mating ends 158 that are disposed along the first receptacle pocket 108*a*, and the second pairs 168 of ground mating ends 158 of the plurality of third leadframe assemblies 120*c* can define respective third and fourth rows of ground mating ends 158 that are disposed along the second receptacle pocket 108*b*. In accordance with the illustrated embodiment, when the complementary electrical connector 16 is mated to the electrical connector 102, the first paddle card 20*a* is received between the respective ground mating ends 158 of the first pairs 166 of ground mating ends 158 disposed along the first receptacle pocket 108*a*, and the second paddle card 20*b* is received between the respective ground mating ends 158 of the second pairs 168 of ground mating ends 158 disposed along the second receptacle pocket 108*b*.

In accordance with the illustrated embodiment, the ground mating ends 158 of the respective first pairs 166 of ground mating ends 158 of the plurality of third leadframe assemblies 120*c* substantially align with the first pairs 144 of mating ends 128 of the respective signal contacts 116 of the pluralities of first and second leadframe assemblies 120*a* and 120*b* when the respective pluralities of first, second, and third leadframe assemblies 120*a*, 120*b*, and 120*c* are supported by the connector housing 112. Similarly, the ground mating ends 158 of the respective second pairs 168 of ground mating ends 158 of the plurality of third leadframe assemblies 120*c* substantially align with the second pairs 146 of mating ends 128 of the respective signal contacts 116 of the pluralities of first and second leadframe assemblies 120*a* and 120*b* when the respective pluralities of first, second, and third leadframe assemblies 120*a*, 120*b*, and 120*c* are supported by the connector housing 112. In this regard, when the complementary electrical connector 16 is mated to the electrical connector 102, the first paddle card 20*a* is received between the respective ground mating ends 158 of the upper pairs 166 of ground mating ends 158 disposed along the first receptacle pocket 108*a*, and the second paddle card 20*b* is received between the respective ground mating ends 158 of the lower pairs 168 of ground mating ends 158 disposed along the second receptacle pocket 108*b*.

The mating ends 128 of the plurality of signal contacts 116 and the ground mating ends 158 of the plurality of crosstalk shields 148 can be offset along the lateral direction A from respective columns. That is, each mating end 128 and each ground mating end 158 may be laterally offset in a direction that is perpendicular to the column direction C along which the respective column of signal contacts 116 extends, or along which the front boundary 152 of the respective crosstalk shield 148 is oriented. In accordance with the illustrated embodiment, the mating ends 128 and the ground mating ends 158 can be offset in alternating lateral directions, or along a direction substantially parallel to the row direction R.

For example, the mating ends 128 of the upper signal contacts 116*a* of the first and second pairs 144 and 146 of signal contacts 116 of a respective one of the first or second leadframe assemblies 120*a* or 120*b* can be offset from the respective column of signal contacts 116 in a first substantially lateral direction toward the first side surfaces 124*e* of the respective housing body 124, and the mating ends 128 of the lower signal contacts 116*b* of the first and second pairs 144 and 146 of signal contacts 116 of the respective one of the first or second leadframe assemblies 120*a* or 120*b* can be offset from the respective column of signal contacts 116 in a second substantially lateral direction that is opposite the first substantially lateral direction, toward the second side surface 124*f* of the respective housing body 124. Similarly, the upper ground mating ends 158 of the first and second pairs 166 and 168 of the crosstalk shield 148 of a respective one of the third leadframe assemblies 120*c* can be offset with respect to the front boundary 152 of the shield body 150 in a first substantially lateral direction toward the first side surfaces 124*e* of the respective housing body 124, and the lower ground mating ends 158 of the first and second pairs 166 and 168 of the crosstalk shield 148 of the respective one of the third leadframe assemblies 120*c* can be offset with respect to the front boundary 152 of the shield body 150 in a second substantially lateral direction that is opposite the first substantially lateral direction, toward the first side surfaces 124*e* of the respective housing body 124.

Figure 8A:
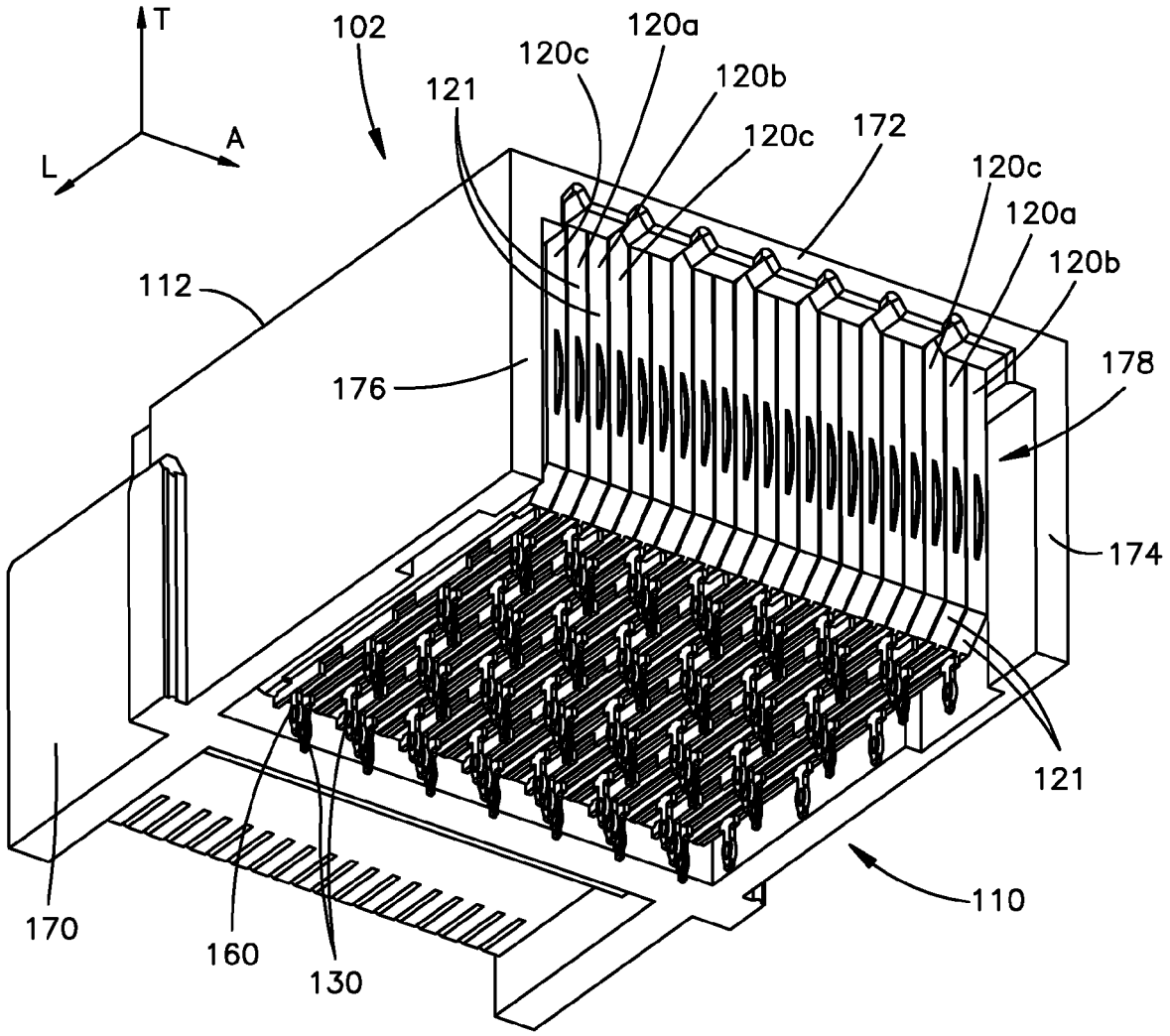
FIG. 8A is perspective view of an electrical connector included in the electrical connector assembly illustrated in FIG. 2.
Figure 8B:
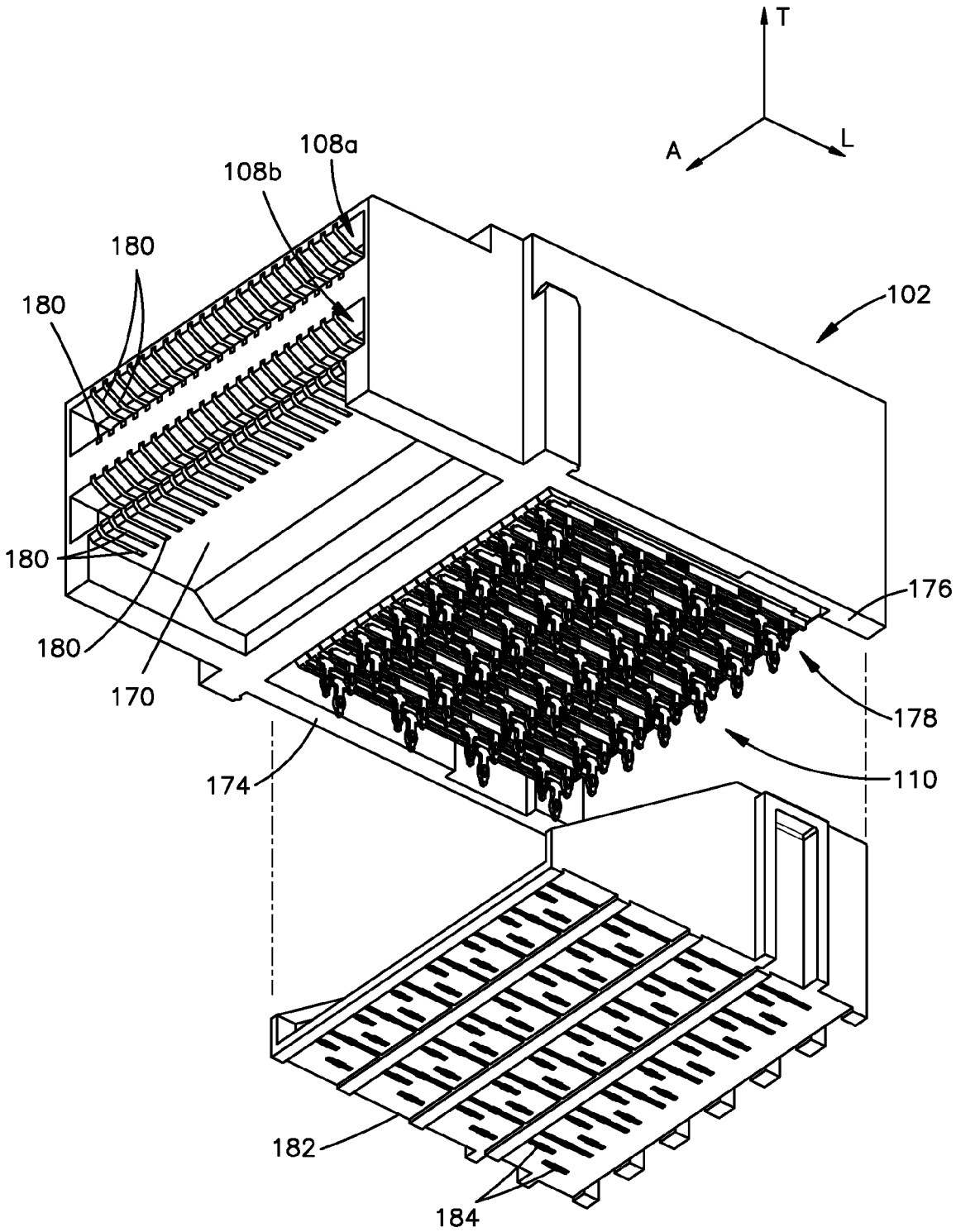
FIG. 8B is a second perspective view of the electrical connector included in the electrical connector assembly illustrated in FIG. 2.

Referring now to FIGS. 8A-8B, the connector housing 112 includes a contact block 170 that at least partially defines the mating interface 108, including the first and second receptacle pockets 108*a* and 108*b*. The contact block 170 can be configured to at least partially receive the mating ends 128 of the plurality of signal contacts 116 and the ground mating ends 158 of the plurality of crosstalk shields 148. The connector housing further includes an upper wall 172 that extends rearward from an upper end of the contact block 170 along the longitudinal direction L, and opposed first and second side walls 174 and 176 that are spaced from each other along the lateral direction and rearward from opposed sides of the contact block 170 and downward from opposed sides of the upper wall 172. The contact block 170, the upper wall 172, and the first and second side walls 174 and 176 can at least partially define a void 178 that is configured to receive the plurality of leadframe housings 120, including the respective pluralities of first, second, and third leadframe assemblies 120*a*, 120*b*, and 120*c*. The contact block 170 can further define a plurality of slots 180 that extend into the first and second receptacle pockets 108*a* and 108*b* along the longitudinal direction and are open to the void 178, each slot 180 configured to receive a respective one of the mating ends 128 of the plurality of signal contacts 116 or ground mating ends 158 of the plurality of crosstalk shields 148. In this regard, it can be said that the void 178 extends forward into the contact block 170. The connector housing 112 can be constructed of any suitable dielectric or insulative material as desired, for instance plastic.

In accordance with the illustrated embodiment, the electrical connector 102 can further include an organizer 182 that is configured to engage with the connector housing 112 so as to at least partially align the plurality of leadframe assemblies 120 with respect to the connector housing 112, thereby at least partially aligning the mating ends 128 and ground mating ends 158 with respect to the mating interface 108, and to at least partially align the mounting ends 130 and ground mounting ends 160 with respect to the mounting interface 110. The organizer 182 can define a plurality of slots 184 that extend through the organizer 182 along the transverse direction T and are elongate along the longitudinal direction L, each of the slots 184 configured to receive a respective one of the mounting ends 130 or ground mounting ends 160.

The plurality of leadframe assemblies 120, including respective ones of the pluralities of first, second, and third leadframe assemblies 120*a*, 120*b*, and 120*c*, can be disposed into the void 178 of the connector housing 112, adjacent to one another, along the lateral direction A, such that the mating ends 128 of the plurality of signal contacts 116 of the pluralities of first and second leadframe assemblies 120*a* and 120*b*, and the ground mating ends 158 of the plurality of crosstalk shields 148 of the plurality of third leadframe assemblies 120*c*, are received in corresponding ones of the slots 180. In accordance with the illustrated embodiment, the plurality of leadframe assemblies 120 are disposed into the void 178 in a repeating pattern that includes a third leadframe assembly 120*c*, followed by a first leadframe assembly 120*a* disposed adjacent to the third leadframe assembly 120*c*, followed by a second leadframe assembly 120*b* disposed adjacent to the first leadframe assembly 120*a*.

The pattern of third, first, and second leadframe assemblies 120*c*, 120*a*, 120*b*, respectively, disposed adjacent to one another, is repeated from left to right across the void 178, between the second and first side walls 176 and 174 of the connector housing 112. In this regard, the pattern of repeating leadframe assemblies 120 defines a repeating pattern of ground leadframe assembly, signal leadframe assembly, signal leadframe assembly, from left to right across the void 178, from the second side wall 176 to the first side wall 174 of the connector housing 112. When the plurality of leadframe assemblies 120 are disposed in the void 178 and fully inserted with respect to the connector housing 112 so as to be supported by the connector housing 112, the mating ends 128 of the plurality of signal contacts 116 and the ground mating ends 158 of the plurality of crosstalk shields 148 are substantially aligned with respect to each other along the transverse direction T and the longitudinal direction L, so as to define respective rows of mating ends 128 and ground mating ends 158 along the row direction R that are disposed in the first and second receptacle pockets 108*a* and 108*b*. In this regard, the pattern of repeating leadframe assemblies 120 defines a repeating pattern of ground contact 118, signal contact 116, signal contact 116 (G-S-S) from left to right across the mating interface 108, from the second side wall 176 to the first side wall 174 of the connector housing 112. Moreover, when the plurality of leadframe assemblies 120 are disposed in the void 178 and fully inserted with respect to the connector housing 112, the front ends 204*a* of the respective leadframe housings 122 of each of the first, second, and third leadframe housings 120*a*, 120*b*, and 120*c* are substantially aligned along a plane defined by the transverse direction T and the lateral direction A.

Figure 9:
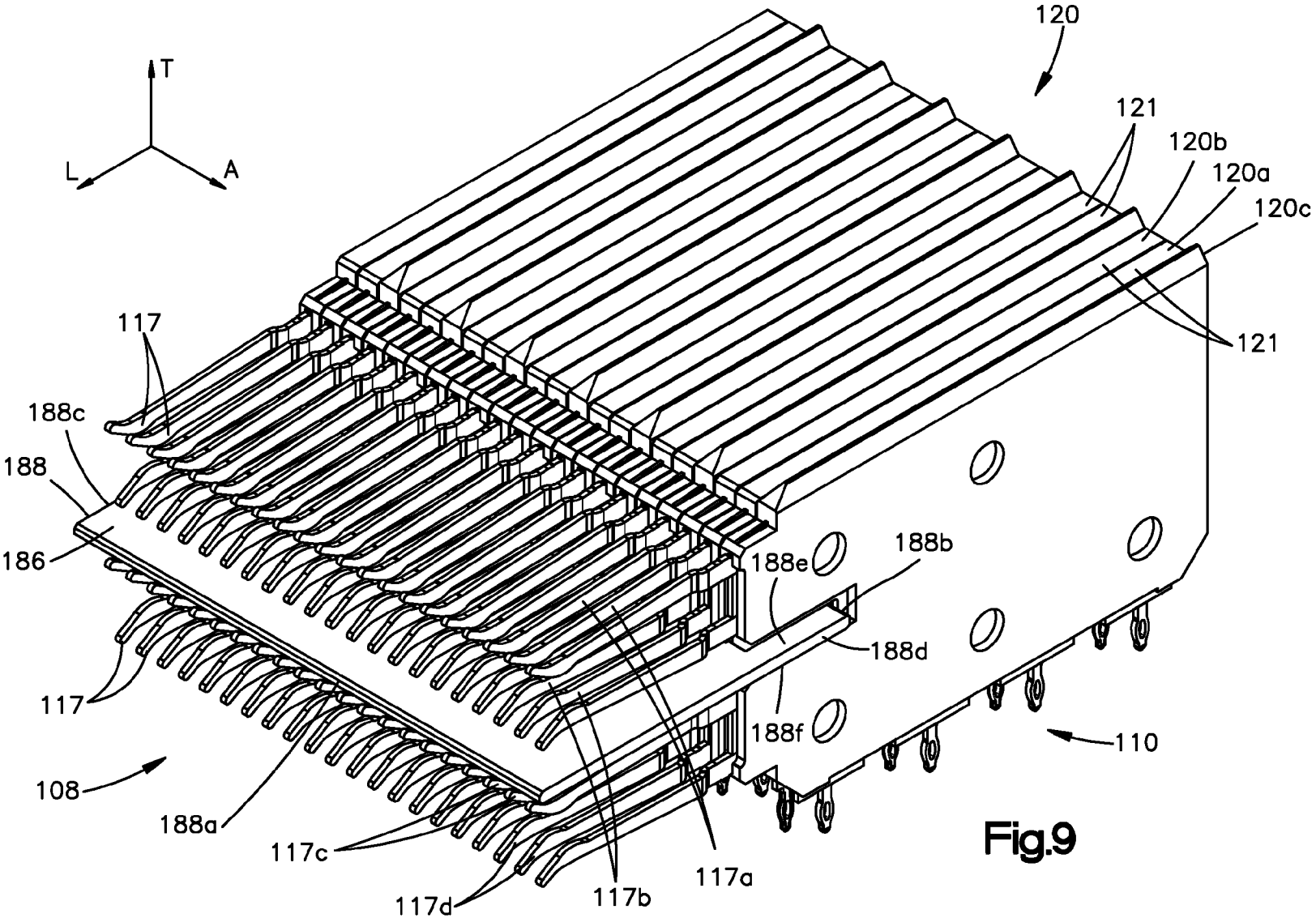
FIG. 9 is a perspective view of a plurality of leadframe assemblies and a ground plate included in the electrical connector assembly illustrated in FIG. 2.

Referring now to FIG. 9, each of the first leadframe assemblies 120*a* can be disposed adjacent to a corresponding one of the second leadframe assemblies 120*b* as supported in the connector housing 112, such that the first and second leadframe assemblies 120*a* and 120*b* define respective pairs 121 that each include a first leadframe assembly 120*a* and a second leadframe assembly 120*b*. For example, in accordance with one embodiment, the first and second leadframe assemblies 120*a* and 120*b* of a respective pair 121 can be disposed adjacent to one another such that the posts 140 of the leadframe housing 122 of the second leadframe assembly 120*b* are received in corresponding ones of the apertures 142 of the leadframe housing 122 of the first leadframe assembly 120*a*. The signal contacts 116 of the first and second leadframe assemblies 120*a* and 120*b* of each pair 121 can define at least one differential signal pair, such as a plurality of differential signal pairs. In accordance with the illustrated embodiment, each pair 121 of first and second leadframe assemblies 120*a* and 120*b* can define a respective plurality of differential signal pairs 117 that can be broadside-coupled, such that the broadsides 134 of the signal contacts 116 of each differential signal pair 117 face each other, though it should be appreciated that the plurality of signal contacts 116 can be alternatively configured as desired. For example, the signal contacts 116 of at least one pair 121, such as each pair 121 of first and second leadframe assemblies 120*a* and 120*b* can be configured as edge-coupled differential signal pairs spaced along the column direction C, such that the edges 136 of the signal contacts 116 of each differential signal pair 117 face each other. Alternatively still, the signal contacts 116 can be configured to define single-ended signal contacts.

In accordance with the illustrated embodiment, each pair 121 of first and second leadframe assemblies 120*a* and 120*b* can define four of the differential signal pairs 117. For example, the mating end 128 of the upper signal contact 116*a* of the first pair 144 of signal contacts 116 of the first leadframe assembly 120*a* of a respective pair 121 and the mating end 128 of the upper signal contact 116*a* of the first pair 144 of signal contacts 116 of the second leadframe assembly 120*b* of a respective pair 121 can define a first broadside-coupled differential signal pair 117*a* of the pair 121. Similarly, the mating end 128 of the lower signal contact 116*b* of the first pair 144 of signal contacts 116 of the first leadframe assembly 120*a* of a respective pair 121 and the mating end 128 of the lower signal contact 116*b* of the first pair 144 of signal contacts 116 of the second leadframe assembly 120*b* of the respective pair 121 can define a second broadside-coupled differential signal pair 117*b* of the pair 121, the mating end 128 of the upper signal contact 116*a* of the second pair 146 of signal contacts 116 of the first leadframe assembly 120*a* of the respective pair 121 and the mating end 128 of the upper signal contact 116*a* of the second pair 146 of signal contacts 116 of the second leadframe assembly 120*b* of the respective pair 121 can define a third broadside-coupled differential signal pair 117*c* of the pair 121, and the mating end 128 of the lower signal contact 116*b* of the second pair 146 of signal contacts 116 of the first leadframe assembly 120*a* of the respective pair 121 and the mating end 128 of the lower signal contact 116*b* of the second pair 146 of signal contacts 116 of the second leadframe assembly 120*b* of the respective pair 121 can define a fourth broadside-coupled differential signal pair 117*d* of the pair 121.

In accordance with the illustrated repeating pattern of leadframe assemblies 120 disposed in the void 178 of the connector housing 112, each pair 121 of first and second leadframe assemblies 120*a* and 120*b* is separated from an adjacent pair 121 of first and second leadframe assemblies 120*a* and 120*b* by a third leadframe assembly 120*c*. Thus, a respective one of the plurality of crosstalk shields 148 is disposed between the signal contacts 116 of each pair 121 of first and second leadframe assemblies 120*a* and 120*b* and a successive pair 121 of first and second leadframe assemblies 120*a* and 120*b*. Two pairs 121 of first and second leadframe assemblies 120*a* and 120*b* can be said to be disposed successively in the void 178 when no other pairs 121 are disposed between the two pairs 121 of first and second leadframe assemblies 120*a* and 120*b*. Each of the plurality of crosstalk shields 148 can operate to shield the differential signal pairs 117 of a respective pair 121 of first and second leadframe assemblies 120*a* and 120*b* from electrical interference generated by the differential signal pairs 117 of other pairs 121 of first and second leadframe assemblies 120*a* and 120*b* disposed in the void 178. It should be appreciated that the electrical connector 102 is not limited to the illustrated arrangement of the plurality of leadframe assemblies 120 in the void 178, and that the electrical connector 102 can be alternatively provided with any other suitable arrangement of first, second, or third leadframe assemblies 120*a*, 120*b*, or 120*c*, in any combination as desired.

Figure 5A:
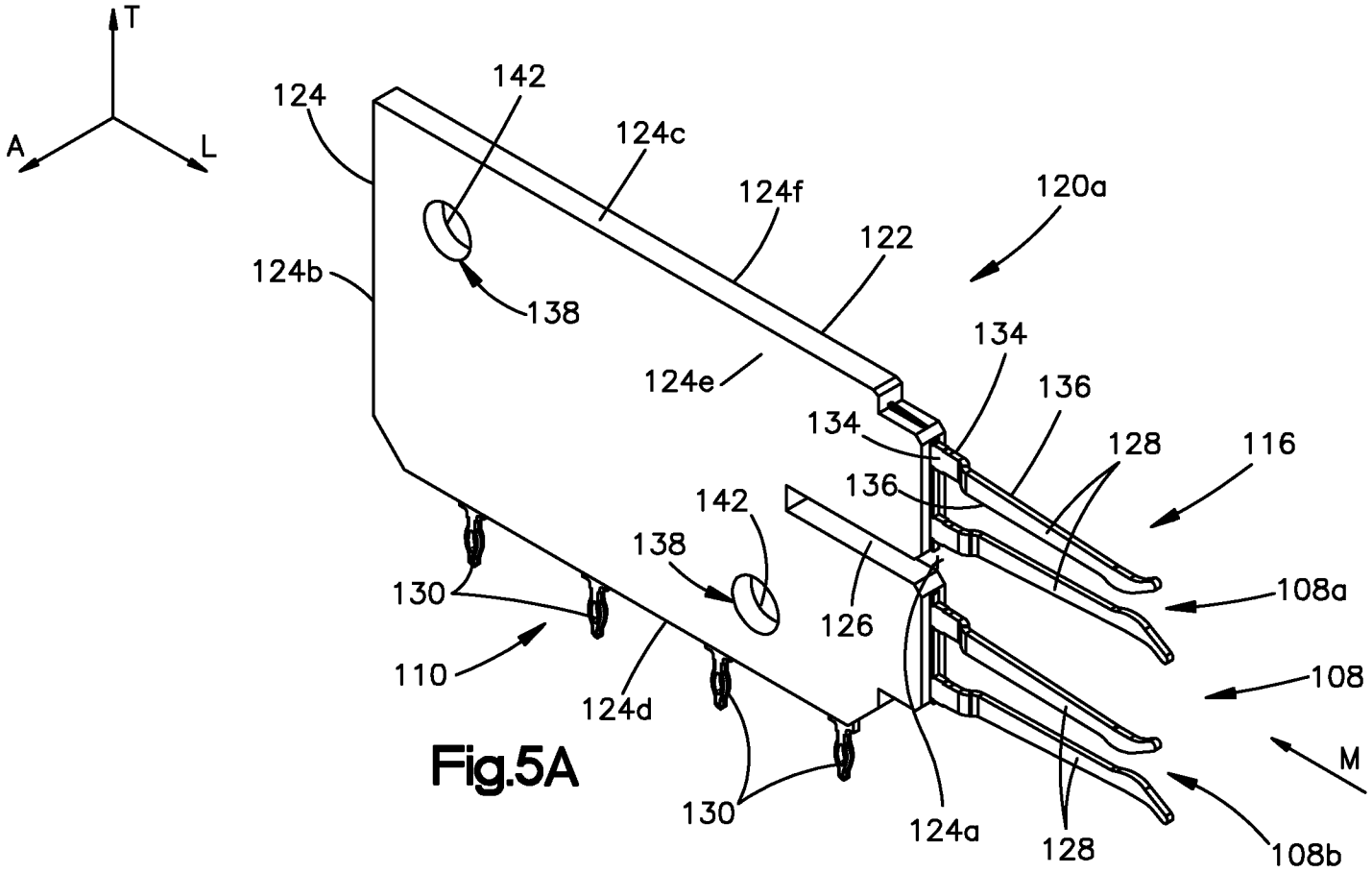
FIG. 5A is a perspective view of a leadframe assembly constructed in accordance with a first embodiment, the leadframe assembly including a leadframe housing and a plurality of electrical signal contacts supported by the leadframe housing.
Figure 5B:
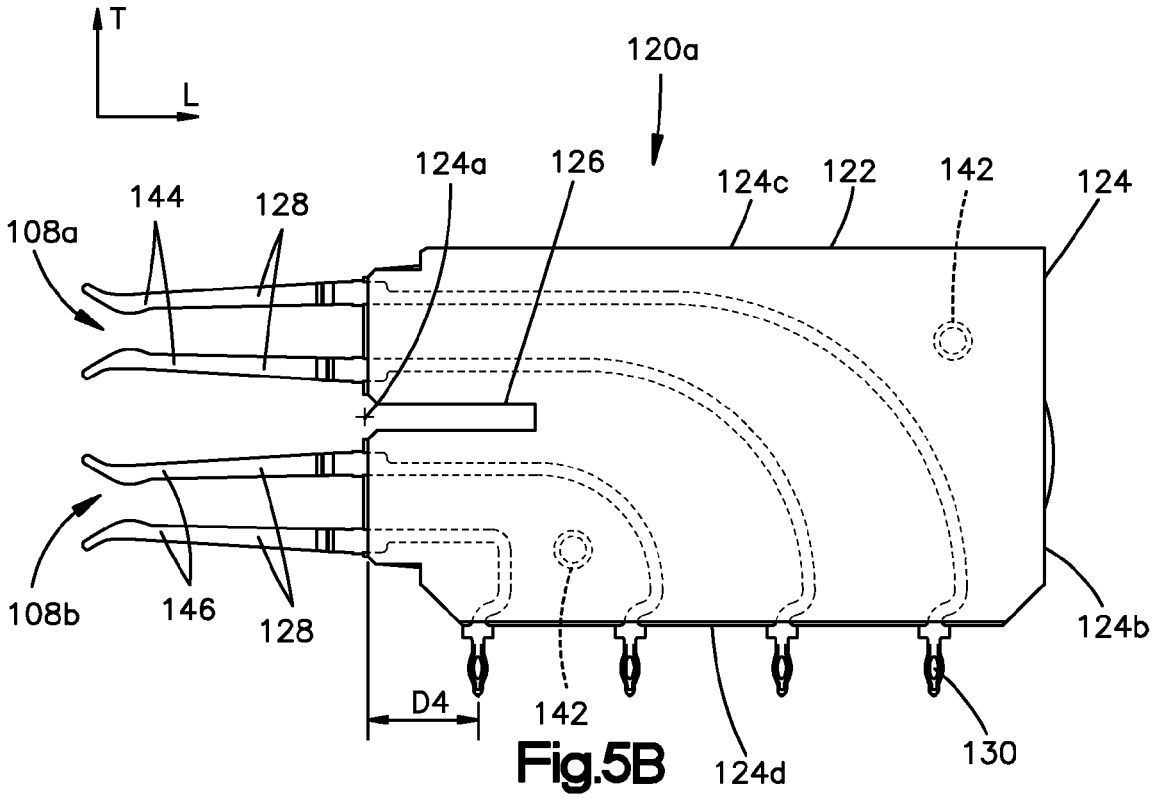
FIG. 5B is a side elevation view of the leadframe assembly illustrated in FIG. 5A.
Figure 5C:
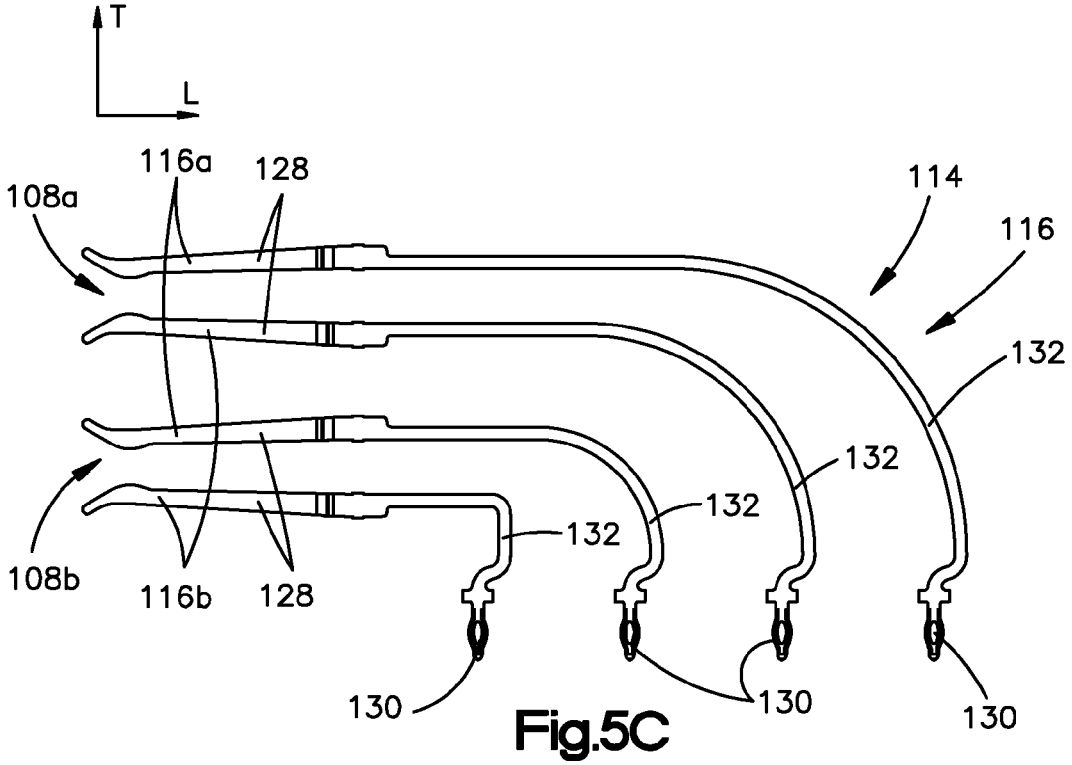
FIG. 5C is a side elevation view of the leadframe assembly illustrated in FIG. 5A with the leadframe housing removed, exposing the plurality of electrical signal contacts.
Figure 6A:
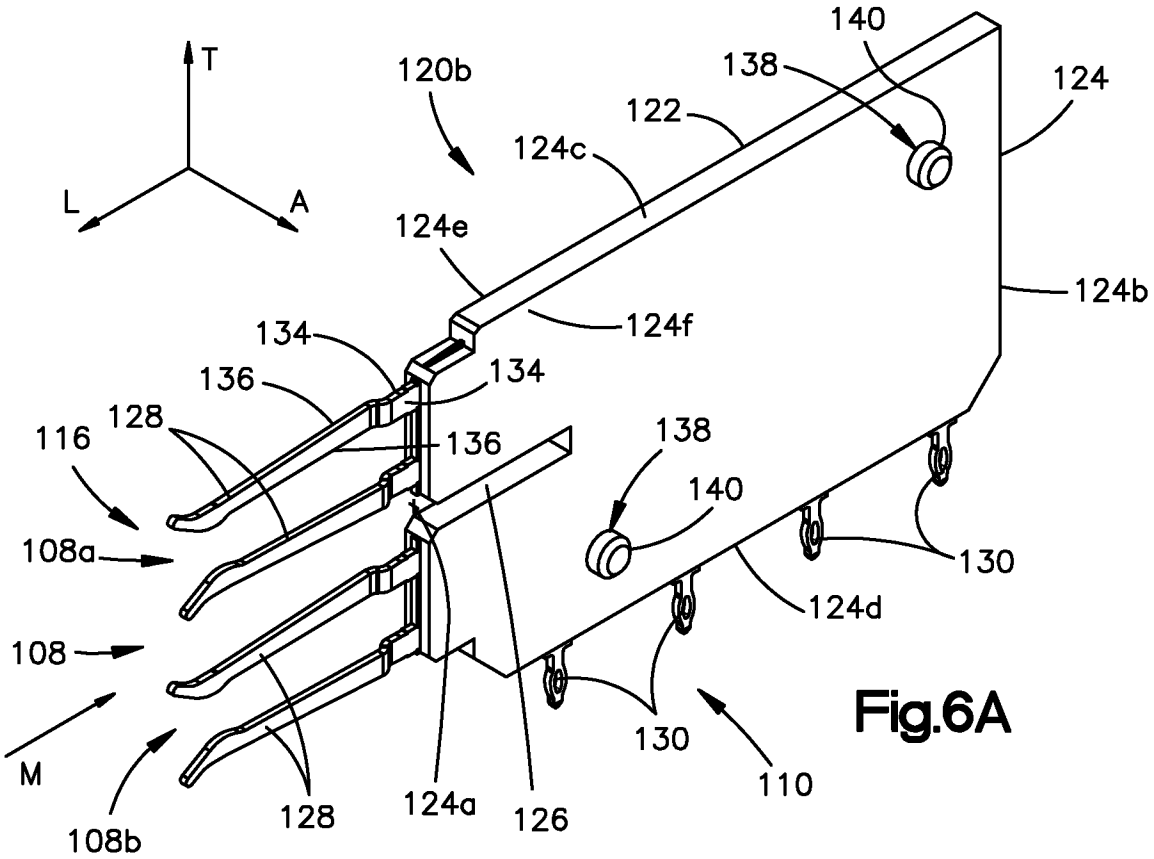
FIG. 6A is a perspective view of a leadframe assembly including a leadframe housing constructed in accordance with a second embodiment, the leadframe assembly including a plurality of electrical signal contacts supported by the leadframe housing.
Figure 6B:
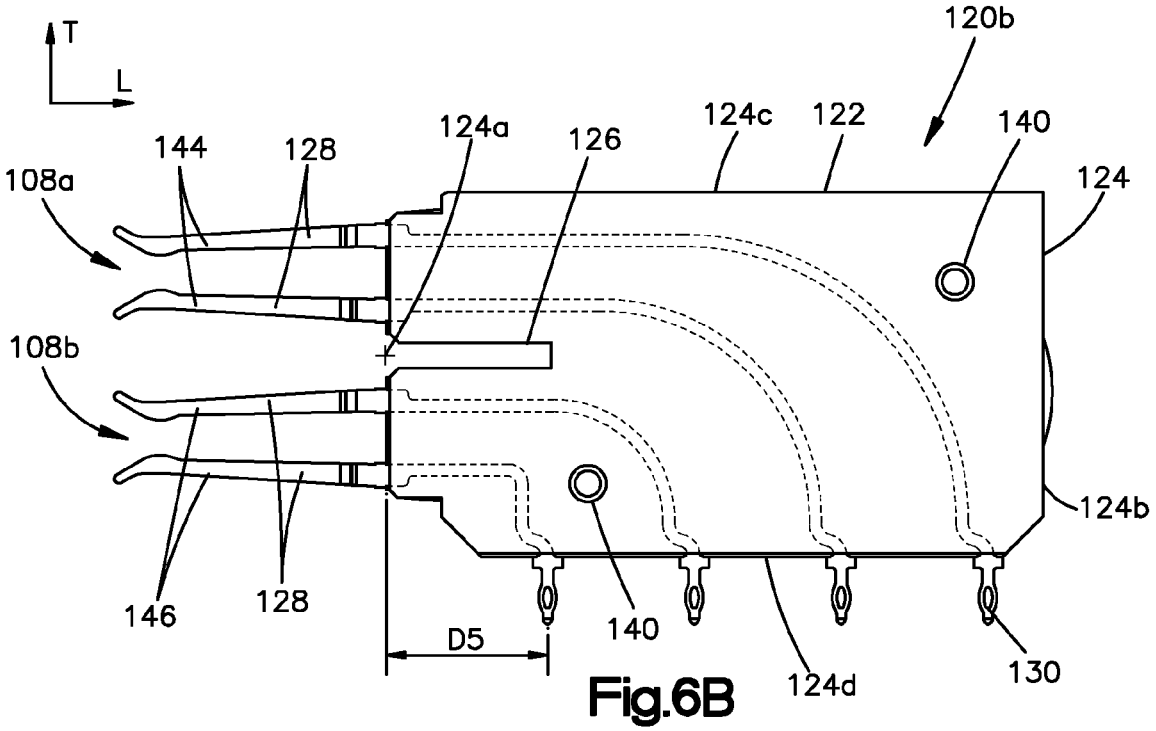
FIG. 6B is a side elevation view of the leadframe assembly illustrated in FIG. 6A.
Figure 6C:
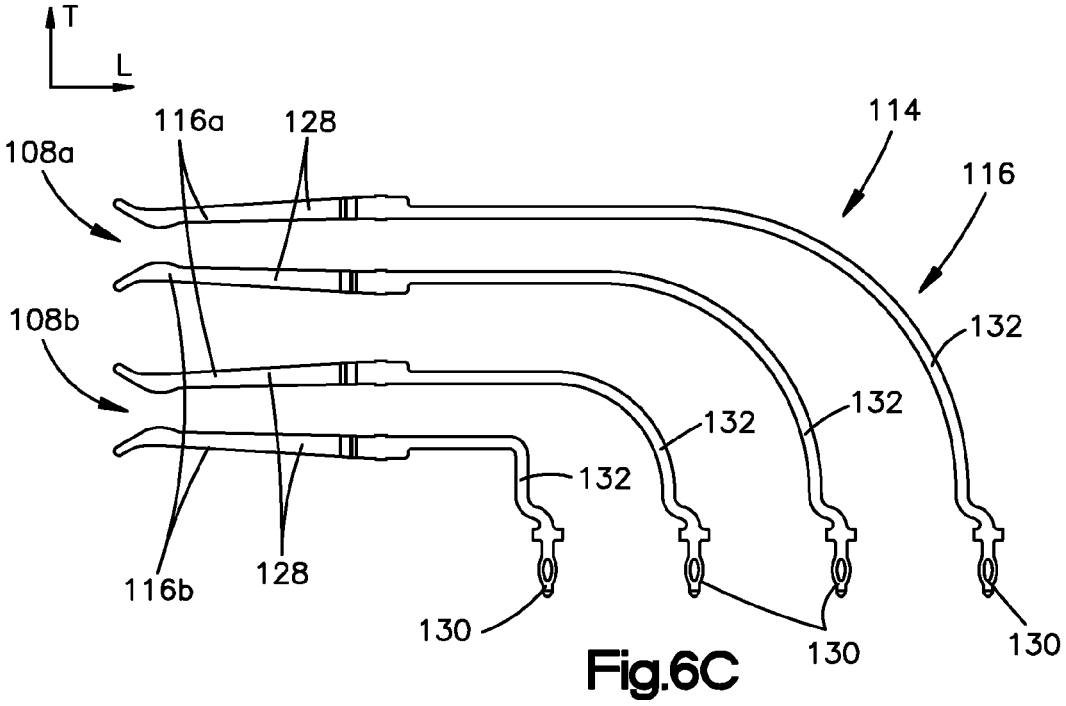
FIG. 6C is a side elevation view of the leadframe assembly illustrated in FIG. 6A with the leadframe housing removed, exposing the plurality of electrical signal contacts.

Referring now to FIGS. 5B, 6B, and 7B, each first leadframe assembly 120*a* supports respective ones of the plurality of signal contacts 116 such that the mounting end 130 that is closest to the front end 124*a* of the housing body 124, that is the mounting end 130 that is closest to the mating interface 108 with respect to the other mounting ends 130 of the first leadframe assembly 120*a*, is spaced from the front end 124*a* a distance D4 along the longitudinal direction L, such that the mounting ends 130 of each first leadframe assembly 120*a* are configured to be inserted into respective electrical signal vias 208 of a respective one of the second columns C2 of vias 206. Likewise, each second leadframe assembly 120*b* supports respective ones of the plurality of signal contacts 116 such that the mounting end 130 that is closest to the front end 124*a* of the housing body 124 is spaced from the front end 124*a* a distance D5 along the longitudinal direction L that is longer than the distance D4, such that the mounting ends 130 of each second leadframe assembly 120*b* are configured to be inserted into respective electrical signal vias 208 of a respective one of the third columns C3 of vias 206. Similarly, each third leadframe assembly 120*c* supports a respective one of the plurality of crosstalk shields 148 such that the ground mounting end 160 that is closest to the front end 124*a* of the housing body 124 is spaced from the front end 124*a* a distance D6 along the longitudinal direction L that is longer than the distance D4 but shorter than the distance D5, such that the ground mounting ends 160 of each third leadframe assembly 120*c* are configured to be inserted into respective electrical ground vias 210 of a respective one of the first columns C1 of vias 206.

Because each of the distances D4, D5, and D6 are unequal, when the plurality of leadframe assemblies 120 are disposed in the void 178 and fully inserted with respect to the connector housing 112, the mounting ends 130 of the first leadframe assemblies 120*a*, the mounting ends 130 of the second leadframe assemblies 120*b*, and the ground mounting ends 160 of the third leadframe assemblies 120*c* are not laterally aligned with respect to each other. Accordingly, a line that extends along the lateral direction A and passes through the geometric centers of the mounting ends 130 of the first leadframe assemblies 120*a* does not pass through the geometric centers of the mounting ends 130 of the second leadframe assemblies 120*b* or the ground mounting ends 160 of the third leadframe assemblies 120*c*. Similarly, a line that extends along the lateral direction A and passes through the geometric centers of the mounting ends 130 of the second leadframe assemblies 120*b* does not pass through the geometric centers of the mounting ends 130 of the first leadframe assemblies 120*a* or the ground mounting ends 160 of the third leadframe assemblies 120*c* and a line that extends along the lateral direction A and passes through the geometric centers of the ground mounting ends 160 of the third leadframe assemblies 120*c* does not pass through the geometric centers of the mounting ends 130 of the first leadframe assemblies 120*a* or the mounting ends 130 of the second leadframe assemblies 120*b*. Moreover, in accordance with the illustrated embodiment each row of ground mating ends 160 is flanked by a first row of mounting ends 130 on a first side of the row and a second row of mounting ends 130 on a second side of the row that is opposite the first side, wherein corresponding ones of the mating ends 128 corresponding to the first and second rows of mounting ends 130 define respective differential signal pairs 117.

It should be appreciated that one or more of each of the first leadframe assemblies 120*a*, the second leadframe assemblies 120*b*, or the third leadframe assemblies 120*c* can be alternatively constructed with different distances D4, D5, and D6, respectively, such that the mounting ends 130 or ground mounting ends 160 of respective ones of the first leadframe assemblies 120*a*, the second leadframe assemblies 120*b*, or the third leadframe assemblies 120*c* can be inserted into respective vias 206 of a substrate 200 alternatively constructed with a plurality of vias 206 arranged in accordance with SFF-8642 Specification, Rev. 2.7, Feb. 26, 2010. In this regard, it should be appreciated that the electrical connector 102 can be alternatively constructed so as to be mounting, or footprint compatible with a substrate constructed in accordance with SFF-8642 Specification, Rev. 2.7, Feb. 26, 2010.

Figure 10:
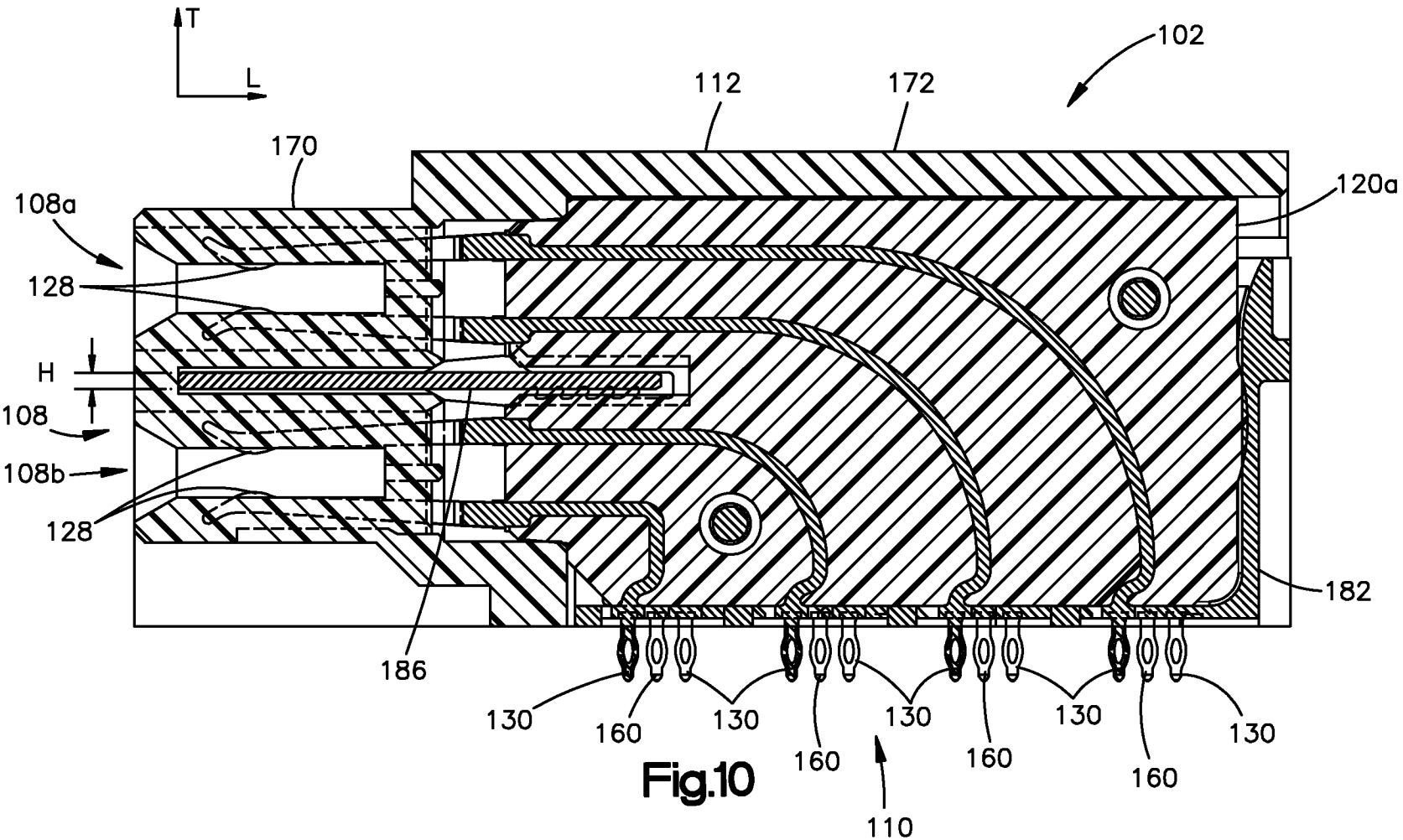
FIG. 10 is a side section view of the electrical connector included in the electrical connector assembly illustrated in FIG. 2.

Referring now to FIGS. 9 and 10, the electrical connector 102 can further include a ground bar 186 that is configured to define a common ground plane within the electrical connector 102. The ground bar 186 has a bar body 188 that defines a front end 188*a*, a rear end 188*b* that is spaced from the front end 188*a* along the longitudinal direction L, first and second opposed sides 188*c* and 188*d* that are spaced from each other along the lateral direction A, an upper surface 188*e*, and an opposed lower surface 188*f* that is spaced from the upper surface 188*e* along the transverse direction T. The ground bar 186 can define a height H along the transverse direction, for example as defined by the upper and lower surfaces 188*e* and 188*f*. The connector housing 112 can be configured to support the ground bar 186 such that the ground bar 186 is disposed proximate the mating interface 108.

For example, the ground bar 186 can be supported by the connector housing 112 such that at least a portion of the ground bar 186 is disposed between respective ones of the mating ends 128 of the plurality of signal contacts 116 and the ground mating ends 158 of the plurality of crosstalk shields 148. In accordance with the illustrated embodiment, a portion of the ground plate that includes the front end 188*a* can be substantially enclosed in the contact block 170 such that the enclosed portion of the ground bar 186 is disposed between the first and second pairs 144 and 146 of signal contacts 116 and between the upper and lower pairs 166 and 168 of ground mating ends 158. In this regard, at least the enclosed portion of the ground bar 186 can operate to shield the differential signal pairs 117 defined by the first pairs 144 of signal contacts 116 from electrical interference generated by the differential signal pairs 117 defined by the second pairs 146 of signal contacts 116, and to shield the differential signal pairs 117 defined by the second pairs 146 of signal contacts 116 from electrical interference, or crosstalk, generated by differential signal pairs 117 defined by the first pairs 144 of signal contacts 116. In this regard, the ground bar 186 can operate as a crosstalk shield with respect to differential signal pairs 117 defined by the first and second pairs 144 and 146 of signal contacts 116, respectively.

Referring additionally to FIGS. 5A-5B, 6A-6B, and 7A-7B, in accordance with the illustrated embodiment each leadframe housing 122 can define a slot 126 that extends into the housing body 124 along the longitudinal direction L, the slot 126 configured to at least partially receive a respective portion of the ground bar 186. Further in accordance with the illustrated embodiment, at least one, such as each of the plurality of crosstalk shields 148 can define a retention slot 190 that is configured to electrically connect the crosstalk shield 148 to the ground bar, such that each crosstalk shield 148 is placed in electrical communication with the common ground plain of the electrical connector 102, and is further configured to retain the ground bar 186 in the retention slot 190. In this regard, it can be said that the front boundary 152 of at last one, such as each of the plurality of crosstalk shields 148 is configured to at least partially receive the ground bar 186. Each retention slot 190 can define an upper surface 190*a* and an opposed lower surface 190*b* that is spaced from the upper surface 190*a* along the transverse direction T.

Each retention slot 190 can include at least one retention member 192, such as a plurality of retention members 192 that are configured to retain a respective portion of the ground bar 186 in the retention slot 190. For instance, in accordance with the illustrated embodiment, each retention slot 190 includes a plurality of substantially tooth shaped retention members 192 that extend upward from the lower surface 190*b* of the retention slot 190 along the transverse direction T and rearward along the longitudinal direction L. A distance D7 between respective ends of the retention members 192 and the upper surface 190*a* of the retention slot 190 is substantially equal to, such as slightly shorter than the height H of the ground bar 186, such that the ground bar 186 is received in the retention slot 190 in an interference fit and the upper surface 188*e* of the ground bar 186 is biased against the upper surface 190*a* of the retention slot 190.

Electrical simulation has demonstrated that the electrical connector 102 can transfer data, for example between the respective mating and mounting ends 128 and 130, respectively, of each signal contact 116, in a range between and including approximately eight gigabits per second (8 Gb/s) and approximately thirty gigabits per second (30 Gb/s) (including approximately ten gigabits per second (10 Gb/s), approximately fourteen gigabits per second (14 Gb/s), and approximately twenty five gigabits per second (25 Gb/s)), such as at a minimum of approximately fourteen gigabits per second (14 Gb/s), including any 0.25 gigabits per second (Gb/s) increments between approximately therebetween, with respective differential insertion loss levels that do not spike above −0.5 dB, and with respective power-summed crosstalk resonance frequencies that fall within a range of about −30 dB to about −60 dB. Furthermore, the herein described embodiments of the electrical connector 102 can operate in a range between and including approximately 1 and 15 GHz, including any 0.25 GHz increments between 1 and 15 GHz, such as at approximately 7 GHz.

Moreover, it was determined through electrical simulation that electrical characteristics can be tuned by replacing at least one select component, for instance a crosstalk shield, of a first electrical connector with a component that has at least one physical characteristic modified with respect to the at least one select component so as to produce the electrical connector 102. In this regard, the electrical connector 102 can be referred to as a modified electrical connector.

Figure 11:
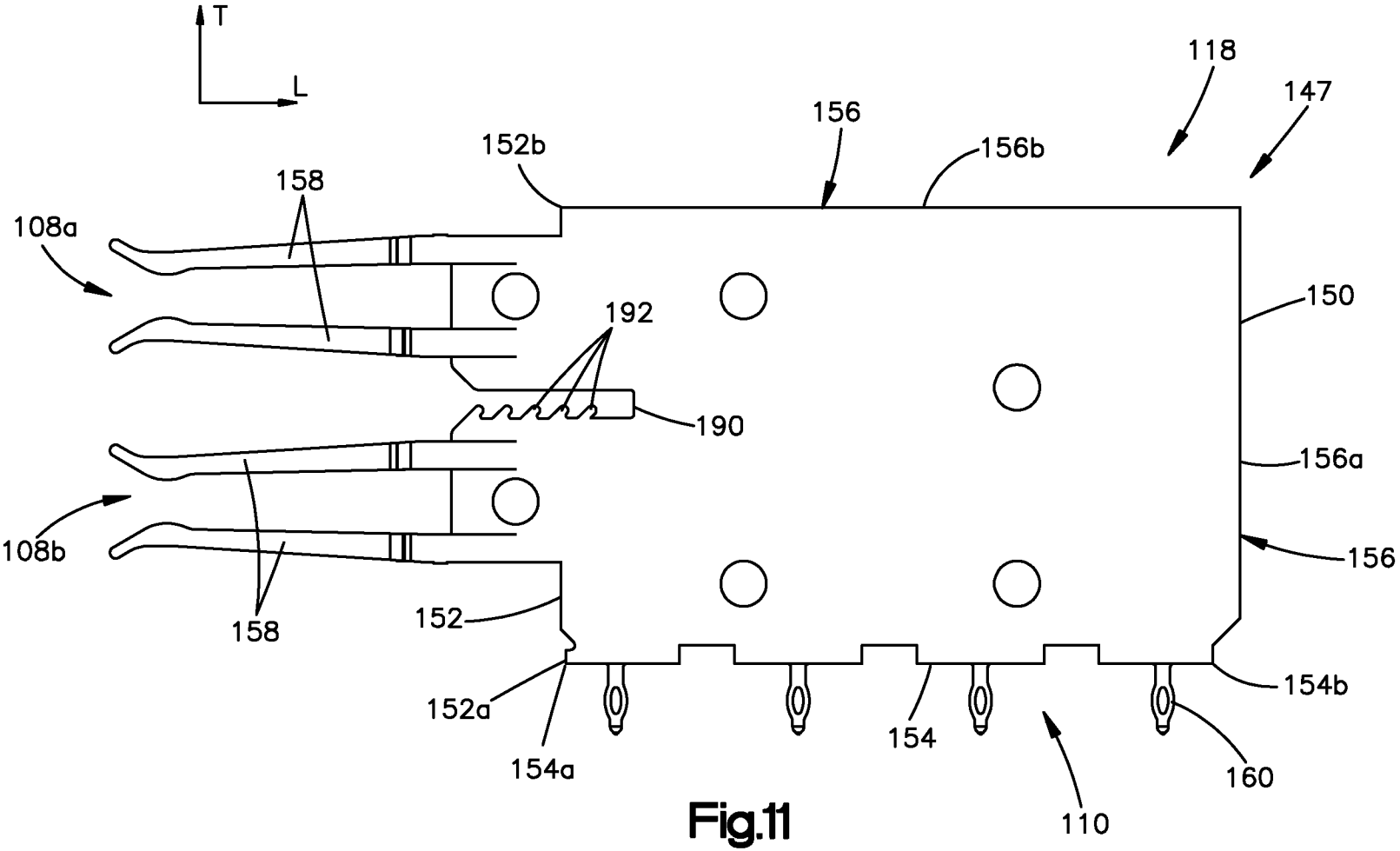
FIG. 11 is a side elevation view a crosstalk shield constructed in accordance with an alternative embodiment.

Referring now to FIG. 11, the first electrical connector can be constructed as illustrated with respect to the electrical connector 102, however the first electrical connector includes a plurality of crosstalk shields 147 instead of the plurality of crosstalk shields 148. Each of the plurality of crosstalk shields 147 can define physical characteristics, in particular respective geometries of the shield bodies 150 that are identical to each other, and thus define respective areas of the crosstalk shields 147 that are equal to each other. The geometries of the shield bodies 150 have been found to at least partially produce an undesirable electrical characteristic, such as an insertion loss at a select resonance frequency, during operation of the first electrical connector. For example, each crosstalk shield 147 has a substantially rectangular shield body 150 that defines a front boundary 152, a lower boundary 154, and at least one outer boundary 156 that extends from the front boundary 152 to the lower boundary 154. The front boundary 152 can extend from a lower front boundary corner 152*a* to an upper front boundary corner 152*b* that is spaced from the lower front boundary corner 152*a* along the transverse direction T. Similarly, the lower boundary 154 can extend from a front lower boundary corner 154*a* that is substantially coincident with the lower front boundary corner 152*a* to a rear lower boundary corner 154*b* that is spaced from the front lower boundary corner 154*a* along the longitudinal direction L. In this regard, it can be said that the front boundary 152 is oriented substantially perpendicular to the lower boundary 154. The outer boundary 156 can define a first outer boundary 156*a* that extends substantially parallel to the front boundary 152 and further defines a second outer boundary 156*b* that extends substantially parallel to the lower boundary 154. Thus, the shield body 150 of each of the plurality of crosstalk shields 147 defines a shield area bounded by a perimeter that includes the front boundary 152, the lower boundary 154, the first outer boundary 156*a*, and the second outer boundary 156*b*. The shield area of the first electrical connector can be referred to as a first shield area.

During operation, the first electrical connector produces insertion loss levels spikes that can exceed −0.5 dB, for instance insertion loss levels spikes in the range of approximately −0.6 dB to approximately 1.2 dB, and power-summed crosstalk resonance frequencies that fall outside a desired range of about −30 dB to about −60 dB, for instance power-summed crosstalk resonance spikes of about −20 dB, which electrical characteristics cause electrical performance of the first electrical connector to deteriorate to marginal levels at data transfer rates of approximately ten gigabits per second (10 Gb/s), and cause the first electrical connector to be substantially non-functional at desired data transfer rates of approximately fourteen gigabits per second (14 Gb/s).

The electrical connector 102, includes crosstalk shields 148, at least one or more up to all of which have a geometry that differs from a corresponding at least one or more up to all of the crosstalk shields 147, which can define first crosstalk shields 147, of the first electrical connector. Thus, the crosstalk shields 148 can be referred to as replacement crosstalk shields that are modified with respect to corresponding crosstalk shields 147 of the first electrical connector. The insertion losses and power-summed crosstalk levels of the electrical connector 102 can be different than those of the first electrical connector at select resonance frequencies. For instance, the insertion losses and power-summed crosstalk levels of the at least certain ones of the plurality of signal contacts 116, including the signal contacts 116 that are disposed adjacent the modified crosstalk shields 148 can be different than those of the first electrical connector.

At least one up to all crosstalk shields 148 of the electrical connector 102 can define a physical characteristic, such as a geometry of the respective shield body 150, that is different than that of a respective at least one up to all of the crosstalk shields 147 of the first electrical connector. In this regard, each crosstalk shield 148 can define a replacement shield area that is bounded by the front boundary 152, the lower boundary 154, and the outer boundary 156. The replacement shield area can be different than, for instance less than as illustrated, the first shield area. For instance, in accordance with one embodiment illustrated in FIGS. 7B-7C, the outer boundary 156 of at least one of the crosstalk shields 148 can be shaped differently than the outer boundary 156 of a corresponding at least one of the crosstalk shields 147. In accordance with the illustrated embodiment, the outer boundary 156 can defines at least a curved section between the front boundary 152 and the lower boundary 154, whereas the outer boundary 156 of the crosstalk shields is defined by substantially straight first and second boundaries 156*a* and 156*b*.

It should be appreciated that one or more up to all of the crosstalk shields 148 can be constructed by stamping or otherwise forming a blank of the material that defines the shield body 150. Alternatively, the crosstalk shields 148 can be constructed by removing at least one or more portions of the shield body 150 from the crosstalk shields 147. Thus, in accordance with the illustrated embodiment, the crosstalk shields 148 can be constructed such that the shield bodies 150 have a reduced amount of material at locations of the outer boundary 156 corresponding in location to the first and second outer boundaries 156*a* and 156*b* of the shield body 150 of the crosstalk shields 147.

It was observed through electrical simulation that the electrical connector 102 constructed substantially identically with respect to the first connector but for the geometric difference of the crosstalk shields 148 with respect to the crosstalk shields 147 exhibits at least one improved electrical characteristic, such as an insertion losses and a power-summed crosstalk level, with respect to the first electrical connector. For example, during operation, each of the plurality of signal contacts 116 of the electrical connector 102 exhibit insertion loss levels that do not spike above −0.5 dB, and the electrical connector 102 exhibits power-summed crosstalk resonance frequencies that fall within a range of about −30 dB to about −60 dB, at data transfer rates of approximately ten gigabits per second (10 Gb/s) and approximately fourteen gigabits per second (14 Gb/s). In this regard, it can be stated that the electrical characteristics of an electrical connector that includes a plurality of crosstalk shields can be tuned by modifying at least one physical characteristic, for instance the shield area, of one or more, such as each of the plurality of crosstalk shields.

It should be appreciated that the crosstalk shield 148 is not limited to the illustrated geometry, and that at least one or more, such as each, of the front boundary 152, the lower boundary 154, and the at least one outer boundary 156 of one or more, such as each of the plurality of crosstalk shields 148 can define any suitable geometric characteristic, such as a shape, that is different than that of the crosstalk shields 147 so as to tune at least one electrical characteristics of the electrical connector 102.

It should be appreciated that a method of constructing a replacement crosstalk shield can comprise manufacturing a crosstalk shield 148 having the different geometry with respect to the crosstalk shields 147, and can alternatively or additionally comprise modifying the shield body 150 of the crosstalk shields 147, for instance removing material from the shield body, so as to produce the crosstalk shields 148. The step of manufacturing the crosstalk shields 148 include the step of creating a virtual model of the crosstalk shield 147 on a processor, such as a virtual model that can be subjected to electrical simulation that exhibits electrical characteristics of a manufactured crosstalk shield 147, and modifying that virtual model to create a virtual model of the crosstalk shield 148, or any combination thereof.

It should be appreciated that the replacement shield area is not limited to less than the first shield area, and the shield bodies 150 of the crosstalk shields 148 can alternatively define a replacement shield area that is greater than the first shield area. It should further be appreciated that the geometry of the shield body 150 of the crosstalk shield 148 is not limited to defining the curved outer boundary 156, and that the outer boundary 156 can be differently configured as desired. For instance, the outer boundary 156 can be alternatively modified to include one or more sections of curvature having a constant radius, one or more sections of curvature having a varying radius, one or more sections that exhibit no curvature, or any combination thereof. Of course, it should be appreciated that the shield bodies 150 of the respective crosstalk shields 148 can be constructing having additional material as desired, in combination with or separately from regions of lesser material with respect to the shield bodies of the crosstalk shields 147. It should further still be appreciated that the first crosstalk shields can be constructed as illustrated with respect to the crosstalk shields 147, or can be alternatively constructed as desired, such that the replacement crosstalk shields 148 define respective replacement shield areas that are different than the corresponding first replacement shield area.

Accordingly, a method of minimizing resonances in an electrical connector can include the step of providing an electrical connector that includes a connector housing, a plurality of signal contacts supported by the connector housing, and a plurality of crosstalk shields supported by the connector housing, wherein the shield body of each of the plurality of crosstalk shields defines a respective first shield area. It should be appreciated that the step of providing can comprise manufacturing an electrical connector, creating a virtual model of an electrical connector, or any combination thereof. The method can further include the step of measuring respective crosstalk resonance frequencies exhibited by the plurality of signal contacts during operation of the electrical connector. If any of the respective crosstalk resonance frequencies does not fall within a range of about −30 dB to about −60 dB, the method can include the step of reconfiguring at least one of the plurality of crosstalk shields, for example by adding or subtracting material from the shield body of the at least one of the plurality of crosstalk shields, such that the at least one of the plurality of crosstalk shields defines a modified shield area that is different than the respective first shield area, and repeating the step of measuring respective crosstalk resonance frequencies exhibited by the plurality of signal contacts during operation of the electrical connector.

The steps of measuring and reconfiguring can be repeated until all of the respective crosstalk resonance frequencies exhibited during operation of the electrical connector fall within the range of about −30 dB to about −60 dB. In accordance with an embodiment, the crosstalk resonance frequencies exhibited by the plurality of signal contacts during operation of the electrical connector are measured during operation of the electrical connector across a range of approximately 5 GHz to approximately 20 GHz. It should be appreciated that the steps of reconfiguring and measuring the respective crosstalk resonance frequencies exhibited by the plurality of signal contacts during operation of the electrical connector can be carried out using electrical simulation, using an actual physical example of the electrical connector, or any combination thereof. It should further be appreciated that reconfiguring does not require that the respective geometries of each of the plurality of crosstalk shields be modified substantially identically. For example, reconfiguring can include modifying the geometries of any number of the plurality of crosstalk shields. Additionally, the respective geometries of one or more of the plurality of crosstalk shields can be modified the same or differently. It should further still be appreciated that the herein described methods of tuning electrical characteristics of the electrical connector, and the herein describe structure of the electrical connector are not limited to applications of CXP electrical connectors, and can alternatively be applied with respect to any other electrical connector having crosstalk shields as desired.

Additionally, a method of minimizing resonances in an electrical connector in accordance with another embodiment can include the step of teaching or providing an electrical connector that includes a connector housing, a plurality of signal contacts supported by the connector housing, and a plurality of crosstalk shields supported by the connector housing. Each of the plurality of crosstalk shields defines a respective first shield area. The method can further include teaching the step of measuring respective crosstalk resonance frequencies exhibited by the plurality of signal contacts during operation of the electrical connector. The method can further include teaching the step of constructing a replacement shield for at least a select one of the plurality of crosstalk shields if any of the respective crosstalk resonance frequencies does not fall within a range of about −30 dB to about −60 dB, such that the replacement shield defines a replacement shield area that is different than the first shield area of the select one of the plurality of crosstalk shields. The method can further include teaching the step of repeating the measuring and constructing steps until all of the respective crosstalk resonance frequencies exhibited during operation of the electrical connector are substantially within the range of about −30 dB to about −60 dB.

A kit can be provided that includes at least one or both of the first electrical connector or the modified electrical connector 102 which can be referred to as a second electrical connector. For instance, the kit can include at least one first electrical connector, such as a plurality of first electrical connectors, can include at least one modified electrical connector 102, such as a plurality of modified electrical connectors 102, or any combination thereof. For example, each first electrical connector of the kit can include a first connector housing 112, a first plurality of signal contacts 116 supported by the first connector housing 112, and a first plurality of crosstalk shields 147 supported by the first connector housing 112. Similarly, each modified electrical connector 102 of the kit can include a second connector housing 112 that is substantially identical to the first connector housing 112 of the first electrical connector, a second plurality of signal contacts 116 supported by the second connector housing 112, the second plurality of signal contacts 116 substantially identical to the first plurality of signal contacts 116 of the first electrical connector, and a second plurality of crosstalk shields 148 supported by the second connector housing 112.

The respective outer boundaries 156 of the crosstalk shields 147 of the first electrical connectors can be shaped differently than the respective outer boundaries 156 of the second plurality of crosstalk shields 148, such that each of the second plurality of crosstalk shields 148 defines respective shield areas that are different than those of the first plurality of crosstalk shields 147. For example, each of the second plurality of crosstalk shields 148 can define respective shield areas that are smaller than the respective shield areas of the first plurality of crosstalk shields 147. It should be appreciated that the first electrical connectors and the modified electrical connectors 102 of the kit are not limited to the respective geometries of the illustrated crosstalk shields 147 and 148, respectively, and that the respective geometries of at least one, such as each of the crosstalk shields 147 or 148, respectively, can be alternatively constructed as desired.

It should further be appreciated that the kit can include a plurality of loose components that can be assembled into one or more electrical connectors, such as the first electrical connector or the modified electrical connector, or any other suitable electrical connector. For instance, the kit can include a plurality of connector housings 112, respective pluralities of first and second leadframe assemblies 120*a* and 120*b*, respectively, and a plurality of third leadframe assemblies 120*c* having crosstalk shields that are constructed the same or differently. For instance respective ones of the plurality of third leadframe assemblies 120*c* can include crosstalk shields having the geometries of the crosstalk shields 147 or 148, respectively, or crosstalk shields having any other suitable geometries, for instance crosstalk shields that define any suitable shield areas, in any combination as desired. In this regard, the respective components of the kit can be assembled into respective electrical connectors so as to tune the respective electrical characteristics of the assembled electrical connectors as desired.

The foregoing description is provided for the purpose of explanation and is not to be construed as limiting the electrical connector. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the electrical connector is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the electrical connector as described herein, and changes may be made without departing from the spirit and scope of the electrical connector, for instance as set forth by the appended claims.

What is claimed:

1. An electrical connector comprising:

a dielectric connector housing;

a plurality of signal contacts supported by the connector housing, each of the plurality of signal contacts defining a mating end, an opposed mounting end, and an intermediate portion that extends from the mating end to the mounting end; and a plurality of leadframe assemblies supported by the connector housing, each of the plurality of leadframe assemblies including a dielectric leadframe housing and a crosstalk shield supported by the leadframe housing, wherein each crosstalk shield has a shield body that defines a front boundary, a lower boundary, and at least one outer boundary defining at least one curved section disposed between the front boundary and the lower boundary, and each crosstalk shield includes a plurality of ground mating ends that extend from the front boundary and a plurality of ground mounting ends that extend from the lower boundary, wherein the leadframe assemblies are devoid of signal contacts.

2. The electrical connector of claim 1, wherein the at least one outer boundary extends from the front boundary to the lower boundary.

3. The electrical connector of claim 2, wherein the front boundary is substantially perpendicular to the lower boundary.

4. The electrical connector of claim 3, wherein the at least one outer boundary comprises a first outer boundary that extends substantially parallel to the front boundary and further comprises a second outer boundary that extends substantially parallel to the lower boundary.

5. The electrical connector of claim 4, further comprising a ground bar supported by the connector housing such that the ground bar is disposed between respective ones of the mating ends and the ground mating ends and the crosstalk shield is electrically connected to the ground bar.

6. The electrical connector of claim 1, further comprising a ground bar supported by the connector housing such that the ground bar is disposed between respective ones of the mating ends and the ground mating ends.

7. The electrical connector of claim 6, wherein the electrical connector operates to transfer data at a minimum of approximately 14 Gigabits/second with respective differential insertion loss levels that do not spike above −0.5 dB.

8. The electrical connector of claim 6, wherein the crosstalk shield is electrically connected to the ground bar.

9. The electrical connector of claim 6, wherein the front boundary of the crosstalk shield is configured to at least partially receive the ground bar.

10. The electrical connector of claim 1, wherein the connector housing at least partially defines a mating interface of the electrical connector and at least partially defines a mounting interface of the electrical connector, and the connector housing supports the crosstalk shield such the front boundary is disposed rearward of the mating interface and the lower boundary is disposed substantially at the mounting interface.

11. The electrical connector of claim 1, wherein the at least one curved section includes one or more sections of curvature having a constant radius.

12. The electrical connector of claim 1, wherein the plurality of leadframe assemblies define third leadframe assemblies, the electrical connector further comprising first and second leadframe assemblies that each include a leadframe housing and respective ones of the plurality of signal contacts that are supported by the leadframe housing.

13. The electrical connector of claim 12, wherein at least one of the third leadframe assemblies is disposed between adjacent pairs, each of the pairs defined by one of the first leadframe assemblies and one of the second leadframe assemblies.

14. The electrical connector of claim 1, wherein the leadframe housing of each of the leadframe assemblies substantially encloses the shield body.

15. A method comprising:

providing an electrical connector that includes a connector housing, a plurality of signal contacts supported by the connector housing, and a plurality of crosstalk shields supported by the connector housing, each of the plurality of crosstalk shields defining a respective first shield area;

measuring respective crosstalk resonance frequencies exhibited by the plurality of signal contacts during operation of the electrical connector;

if any of the respective crosstalk resonance frequencies does not fall within a range of about −30 dB to about −60 dB, constructing a replacement shield for at least a select one of the plurality of crosstalk shields such that the replacement shield defines a replacement shield area that is different than the first shield area of the select one of the plurality of crosstalk shields; and repeating the measuring and constructing steps until all of the respective crosstalk resonance frequencies exhibited during operation of the electrical connector are substantially within the range of about −30 dB to about −60 dB.

16. The method of claim 15, wherein the step of measuring respective crosstalk resonance frequencies exhibited by the plurality of signal contacts during operation of the electrical connector comprises measuring respective crosstalk resonance frequencies exhibited by the plurality of signal contacts during operation of the electrical connector across a range of 5 GHz to 20 GHz.

17. The method of claim 15, wherein each of the plurality of crosstalk shields has a shield body that defines a front boundary, a lower boundary, and at least one outer boundary that extends from the front boundary to the lower boundary, such that the first shield area is bounded by the front boundary, the lower boundary, and the at least one outer boundary, and wherein the step of reconfiguring at least one of the plurality of crosstalk shields comprises reconfiguring the at least one outer boundary.

18. A kit comprising:

a first electrical connector that includes:

a first connector housing;

a first plurality of signal contacts supported by the first connector housing, each of the first plurality of signal contacts defining a mating end, an opposed mounting end, and an intermediate portion that extends from the mating end to the mounting end; and a first plurality of crosstalk shields supported by the first connector housing, each of the first plurality of crosstalk shields having a shield body that defines a front boundary, a lower boundary, and an outer boundary, each of the first plurality of crosstalk shields including a plurality of ground mating ends that extend from the front boundary and a plurality of ground mounting ends that extend from the lower boundary; and a second electrical connector that includes:

a second connector housing identical to the first connector housing;

a second plurality of signal contacts identical to the first plurality of signal contacts; and a second plurality of crosstalk shields supported by the second connector housing, each of the second plurality of crosstalk shields having a shield body that defines a front boundary, a lower boundary, and an outer boundary that is shaped differently than the outer boundary of the first plurality of crosstalk shields, such that each of the second plurality of crosstalk shields defines respective areas different than those of the first plurality of crosstalk shields.

19. The kit of claim 18, wherein the respective areas of each of the second plurality of crosstalk shields are smaller than those of the first plurality of crosstalk shields.

20. The kit of claim 19, wherein during operation of the second electrical connector, the second plurality of signal contacts exhibit insertion loss levels that do not spike above −0.5 dB and the second electrical connector exhibits power-summed crosstalk resonance frequencies that fall within a range of about −30 dB to about −60 dB.

21. The kit of claim 18, wherein the respective outer boundaries of at least one of the first or second pluralities of crosstalk shields define respective curved sections between the respective front boundaries and the respective lower boundaries.

22. The kit of claim 18, wherein the respective outer boundaries of at least one of the first or second pluralities of crosstalk shields define respective first outer boundaries that extend substantially parallel to the respective front boundaries and define respective second outer boundaries that extend substantially parallel to the respective lower boundaries.

23. A method of minimizing resonances in an electrical connector, the method comprising the steps of:

teaching or providing an electrical connector that includes a connector housing, a plurality of signal contacts supported by the connector housing, and a plurality of crosstalk shields supported by the connector housing, each of the plurality of crosstalk shields defining a respective first shield area;

teaching the step of measuring respective crosstalk resonance frequencies exhibited by the plurality of signal contacts during operation of the electrical connector;

teaching the step of constructing a replacement shield for at least a select one of the plurality of crosstalk shields if any of the respective crosstalk resonance frequencies does not fall within a range of about −30 dB to about −60 dB, such that the replacement shield defines a replacement shield area that is different than the first shield area of the select one of the plurality of crosstalk shields; and teaching the step of repeating the measuring and constructing steps until all of the respective crosstalk resonance frequencies exhibited during operation of the electrical connector are substantially within the range of about −30 dB to about −60 dB.

* * * * *